US006575127B2

(12) United States Patent
Kobayashi

(10) Patent No.: US 6,575,127 B2
(45) Date of Patent: Jun. 10, 2003

(54) VALVE OPERATING CONTROL SYSTEM IN ENGINE

(75) Inventor: Toshiki Kobayashi, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 44 days.

(21) Appl. No.: 09/983,121

(22) Filed: Oct. 23, 2001

(65) Prior Publication Data

US 2002/0056425 A1 May 16, 2002

(30) Foreign Application Priority Data

Oct. 25, 2000 (JP) ..... 2000-325431

(51) Int. Cl.[7] ..... F01L 1/34

(52) U.S. Cl. ..... 123/90.15; 123/90.16; 123/90.17; 123/90.33

(58) Field of Search ..... 123/90.33, 90.34, 123/90.35, 90.36, 90.37, 90.38, 90.15, 90.16, 90.17

(56) References Cited

U.S. PATENT DOCUMENTS 5,813,376 A 9/1998 Sakaguchi et al. ..... 123/90.16
6,076,492 A * 6/2000 Takahashi ..... 123/90.17
6,260,523 B1 * 7/2001 Nakamura et al. ..... 123/90.15

FOREIGN PATENT DOCUMENTS

EP 0 937 865 A1 8/1999
JP 9-209722 8/1997

* cited by examiner

*Primary Examiner*—Thomas Denion
*Assistant Examiner*—Jaime Corrigan
(74) *Attorney, Agent, or Firm*—Armstrong, Westerman & Hattori, LLP

(57) ABSTRACT

A pair of valve-timing controlling oil passages leading to a second valve-operating characteristic changing mechanism are defined in a lower camshaft holder, and a valve lift controlling oil passage leading to a first valve-operating characteristic changing mechanism is defined between the pair of valve-timing controlling oil passages in a mating surface of the lower camshaft holder with a cylinder head. In an area where the width of the valve lift controlling oil passage is reduced in order to avoid the interference with the valve-timing controlling oil passages, the depth of the valve lift controlling oil passage is larger than that in the other positions, whereby a sectional area of the oil passage is secured. Thus, the oil passages leading to the first and second mechanisms can be formed compact in a camshaft support member.

9 Claims, 16 Drawing Sheets

TOP VIEW OF LOWER CAMSHAFT HOLDER

VALVE OPERATING CONTROL SYSTEM IN ENGINE

BACKGROUND OF THE INVENTION

1. Field of the Invention

The present invention relates to a valve operating control system for an engine, including a first valve-operating characteristic changing mechanism adapted to change the valve lift, and a second valve-operating characteristic changing mechanism adapted to change the valve timing.

2. Description of the Related Art

There is a conventionally known valve operating control system for an engine, which includes a valve-operating characteristic changing mechanism provided between a camshaft and a sprocket for driving the camshaft, so that the phase of the sprocket relative to the camshaft is changed in accordance with the operational state of the engine to change the valve timing. There is also such a valve operating control system known from Japanese Patent Application Laid-open No. 9-209722, in which an advance oil chamber and a delay oil chamber are formed in a camshaft supporting portion.

In an engine including a first valve-operating characteristic changing mechanism adapted to change the valve lift in accordance with the operational state of the engine, and a second valve-operating characteristic changing mechanism adapted to change the valve timing in accordance with the operational state of the engine, the first valve-operating characteristic changing mechanism is mounted on a rocker arm supported on a rocker arm shaft, and the second valve-operating characteristic changing mechanism is mounted at an end of a camshaft. For this reason, it is required that a control oil passage leading to the first valve-operating characteristic changing mechanism and an advance oil passage and a delay oil passage leading to the second valve-operating characteristic changing mechanism are defined in a camshaft support member for supporting the camshaft and the rocker arm shaft. However, the camshaft support member is provided with bolts bores for fastening the camshaft support member and for this reason, it is difficult to secure a sufficient sectional area of a flow path in each of the control oil passage, the advance oil passage and the delay oil passage without an increase in size of the camshaft support member and while avoiding the interference with the bolts bores, and there is a possibility that the sectional area of each of the oil passages is insufficient, resulting in a degraded responsiveness of each of the first and second valve-operating characteristic changing mechanism.

SUMMARY OF THE INVENTION

Accordingly, it is an object of the present invention to ensure that the oil passages leading to the first valve-operating characteristic changing mechanism adapted to change the valve lift and the second valve-operating characteristic changing mechanism adapted to change the valve timing are defined compactly in the camshaft support member.

To achieve the above object, according to a first aspect and feature of the present invention, there is provided a valve operating control system for an engine, including a first valve-operating characteristic changing mechanism adapted to change the valve lift, and a second valve-operating characteristic changing mechanism adapted to change the valve timing, wherein a pair of valve-timing controlling oil passages leading to the second valve-operating characteristic changing mechanism are defined in a camshaft support member, and a valve lift controlling oil passage leading to the first valve-operating characteristic changing mechanism is defined between the pair of valve-timing controlling oil passages in a mating surface of the camshaft support member with another member.

With the above arrangement, the pair of valve-timing controlling oil passages leading to the second valve-operating characteristic changing mechanism and the valve lift controlling oil passage leading to the first valve-operating characteristic changing mechanism are defined in the camshaft support member, and the valve lift controlling oil passage is defined between the pair of valve-timing controlling oil passages in the mating surface of the camshaft support member with another member. Therefore, the pair of valve-timing controlling oil passages and the valve lift controlling oil passage can be formed compactly in the camshaft support member, so that they do not interfere with each other.

According to a second aspect and feature of the present invention, in addition to the first feature, the depth of the valve lift controlling oil passage in a position where the valve lift controlling oil passage and the pair of valve-timing controlling oil passages are overlapped on each other as viewed in an axial direction of a camshaft is larger than that in the other positions.

With the above arrangement, even if the width of the valve lift controlling oil passage is reduced in the position where the valve lift controlling oil passage and the pair of valve-timing controlling oil passages are overlapped on each other as viewed in the axial direction of the camshaft in order to avoid the interference with the valve-timing controlling oil passages, it is possible to secure a sectional area of a flow path in the valve lift controlling oil passage without an increase in size of the camshaft support member, because the depth of the valve lift controlling oil passage is larger than that in the other positions.

According to a third aspect and feature of the present invention, in addition to the first or second feature, the camshaft support member is fastened to another member by bolts; the pair of valve-timing controlling oil passages are defined in the mating surface of the camshaft support member with another member, and the depths of the pair of valve-timing controlling oil passages in a position where the pair of valve-timing controlling oil passages and the bolts are overlapped on each other as viewed in the axial direction of the camshaft are larger than those in the other positions.

With the above arrangement, even if the pair of valve-timing controlling oil passages are defined in the mating surface of the camshaft support member fastened to another member by the bolts, and the widths of the valve-timing controlling oil passages in the position where the pair of valve-timing controlling oil passages and the bolts are overlapped on each other as viewed in the axial direction of the camshaft are larger than those in other positions, it is possible to secure a sectional area of a flow path in each of the valve-timing controlling oil passages without an increase in size of the camshaft support member, because the depths of the valve-timing controlling oil passages are larger than those in the other positions.

According to a fourth aspect and feature of the present invention, in addition to any of the first to third features, the camshaft support member includes a support portion for a rocker arm shaft, and the pair of valve-timing controlling oil passages are defined in the vicinity of the support portion.

With the above arrangement, the pair of valve-timing controlling oil passages are defined in the vicinity of the support portion for the rocker arm shaft and hence, the support portion is reinforced by a cylindrical portion defining the valve-timing controlling oil passages, leading to an enhanced supported rigidity of the rocker arm shaft.

According to a fifth aspect and feature of the present invention, in addition to the first feature, the width of the valve lift controlling oil passage in a longitudinal direction of the camshaft in a position where the valve lift controlling oil passage and the pair of valve-timing controlling oil passages are overlapped on each other as viewed in the axial direction of the camshaft is smaller than that in the other positions.

With the above arrangement, the width of the valve lift controlling oil passage in the longitudinal direction of the camshaft in the position where the valve lift controlling oil passages and the pair of valve-timing controlling oil passages are overlapped on each other as viewed in the axial direction of the camshaft is smaller than that in other positions. Therefore, the pair of valve-timing controlling oil passages can be disposed in proximity to each other to contribute to the compactness of the camshaft support member.

According to a sixth aspect and feature of the present invention, in addition to the first feature, the camshaft support member is fastened to another member by bolts; the pair of valve-timing controlling oil passages are defined in the mating surface of the camshaft support member with another member, and the widths of the pair of valve-timing controlling oil passages in a longitudinal direction of the camshaft in a position where the pair of valve-timing controlling oil passages and the bolts are overlapped on each other as viewed in the axial direction of the camshaft are smaller than those in the other positions.

With the above arrangement, in the position where the pair of the valve-timing controlling oil passages defined in the mating surface of the camshaft support member with another member is overlapped on the bolts for fastening the camshaft support member to another member as viewed in the axial direction of the camshaft, the widths of the pair of valve-timing controlling oil passages are smaller than those in the other positions. Therefore, the pair of valve-timing controlling oil passages can be disposed in proximity to each other to contribute to the compactness of the camshaft support member.

According to a seventh aspect and feature of the present invention, in addition to the first, second or fifth feature, the position where the valve lift controlling oil passage and the pair of valve-timing controlling oil passages are overlapped on each other as viewed in the axial direction of the camshaft is between the bolts for fastening the camshaft support member mounted between a plurality of the camshafts to the cylinder head.

With the above arrangement, the position where the valve lift controlling oil passage and the pair of valve-timing controlling oil passages are overlapped on each other as viewed in the axial direction of the camshaft is between the bolts for fastening the camshaft support member mounted between the plurality of camshafts to the cylinder head. Therefore, it is possible to effectively inhibit the leakage of oil between the valve lift controlling oil passage and the pair of valve-timing controlling oil passages by fastening forces of the bolts.

An intake camshaft 12 in an embodiment corresponds to the camshaft of the present invention; a lower camshaft holder 25 in the embodiment corresponds to the camshaft support member of the present invention; an intake rocker arm shaft 32 in the embodiment corresponds to the rocker arm shaft of the present invention; an oil passage P11 in the embodiment corresponds to the valve lift controlling oil passage of the present invention; and oil passages P18*a*, P18*b*, P19*a* and P19*b* in the embodiment correspond to the valve-timing controlling oil passages of the present invention. In addition, a cylinder head 23 in the embodiment corresponds to another member in claims of the present invention, and an upper camshaft holder 26 in the embodiment corresponds to another member in claim 3 of the present invention.

The above and other objects, features and advantages of the invention will become apparent from the following description of the preferred embodiment taken in conjunction with the accompanying drawings.

BRIEF DESCRIPTION OF THE DRAWINGS

FIGS. 1 to 16 show an embodiment of the present invention, wherein

FIG. 1 is a perspective view of an engine;

FIG. 2 is an enlarged view taken in a direction of an arrow 2 in FIG. 1;

FIG. 3 is an enlarged view taken in a direction of an arrow 3 in FIG. 1;

FIG. 4 is a sectional view taken along a line 4—4 in FIG. 3;

FIG. 5 is an enlarged view of an essential portion shown in FIG. 4;

FIG. 6 is a view similar to FIG. 5 but for explaining the operation;

FIG. 7 is a view taken along a line 7—7 in FIG. 3;

FIG. 8 is an enlarged sectional view taken along a line 8—8 in FIG. 3;

FIG. 9 is an enlarged sectional view of an essential portion shown in FIG. 3;

FIG. 10 is an enlarged sectional view taken along a line 10—10 in FIG. 2;

FIG. 11 is a sectional view taken along a line 11—11 in FIG. 3;

FIG. 12 is a sectional view taken along a line 12—12 in FIG. 11;

FIG. 13 is a sectional view taken along a line 13—13 in FIG. 3;

FIG. 14 is a view taken along a line 14—14 in FIG. 13;

FIG. 15 is a view taken along a line 15—15 in FIG. 13; and

FIG. 16 is a sectional view taken along a line 16—16 in FIG. 15.

DESCRIPTION OF THE PREFERRED EMBODIMENT

The present invention will now be described by way of an embodiment of the present invention with reference to the accompanying drawings.

Figure 1:
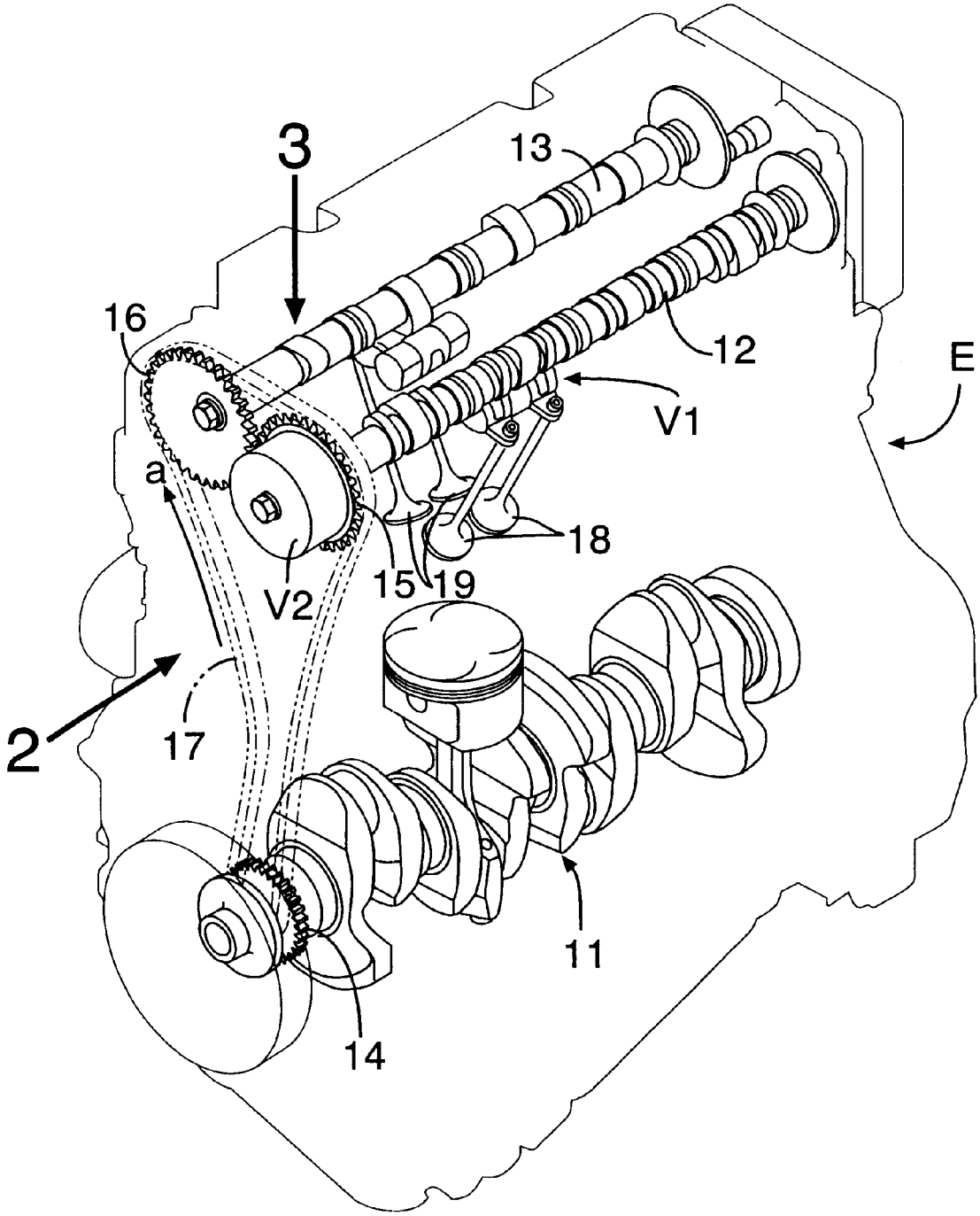

Referring to FIG. 1, a DOHC type 4-cylinder straight engine E includes a crankshaft 1, an intake camshaft 12 and an exhaust camshaft 13. A timing chain 17 is reeved around a crankshaft sprocket 14 mounted at end of the crankshaft 11, an intake camshaft sprocket 15 mounted at end of the intake camshaft 12 and an exhaust camshaft sprocket 16 mounted at end of the exhaust camshaft 13. The timing chain 17 is driven in a direction of an arrow a by the crankshaft 11, whereby the intake camshaft 12 and the exhaust camshaft 13 are rotated at a speed half of the speed of the crankshaft 11. Each of cylinders includes two intake valves 18, 18 driven by the intake camshaft 12, and two exhaust valves 19, 19 driven by the exhaust camshaft 13. The lift amount and opening duration of each of the two intake valves 18, 18 are capable of being varied by a first valve-operating characteristic changing mechanism V1 provided for each of the cylinders, and the timing of opening of each of the intake valves 18, 18 is capable of being varied by a second valve-operating characteristic changing mechanism V2 provided at an end of the intake camshaft 12.

Figure 2:
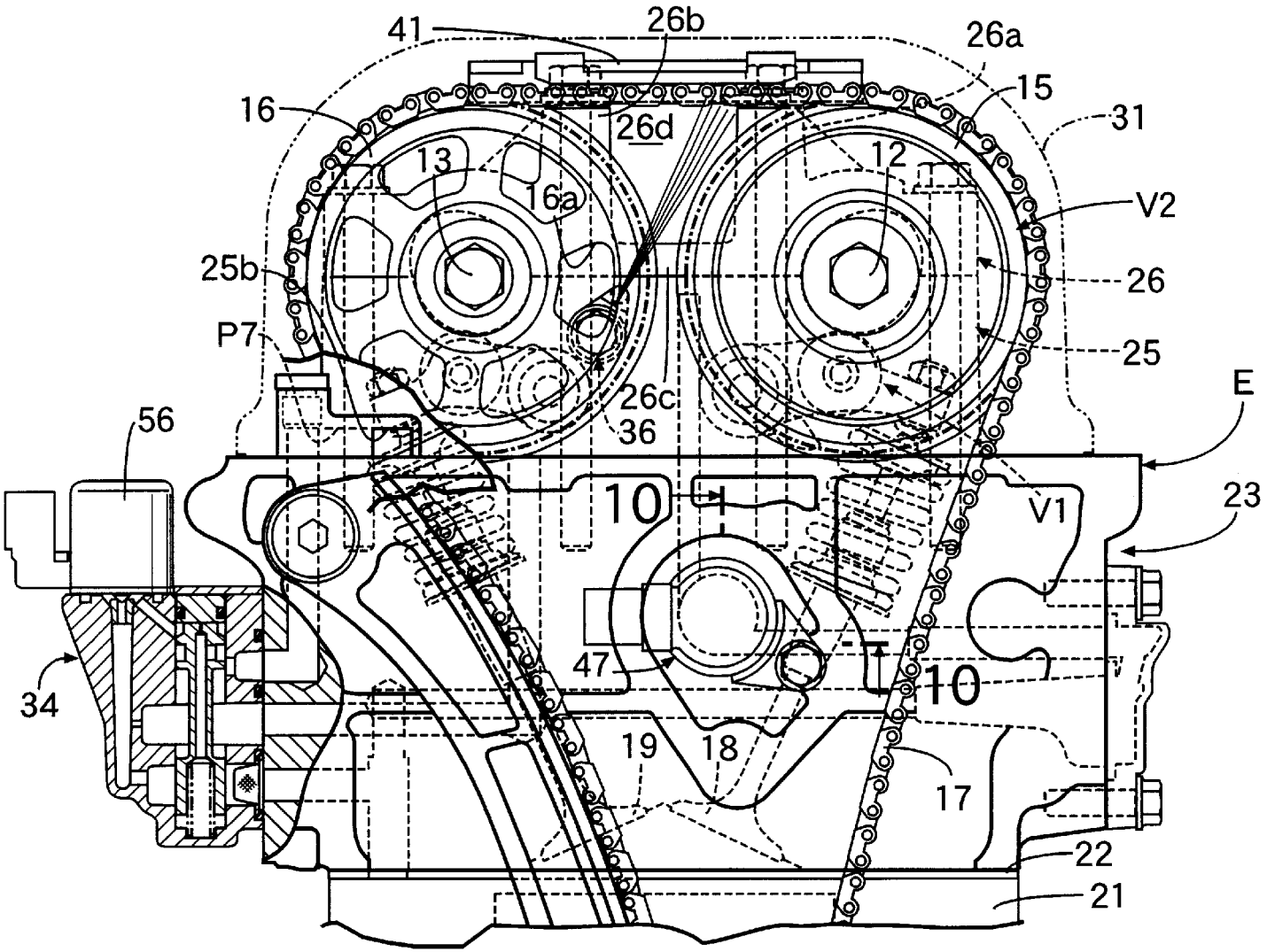
Figure 3:
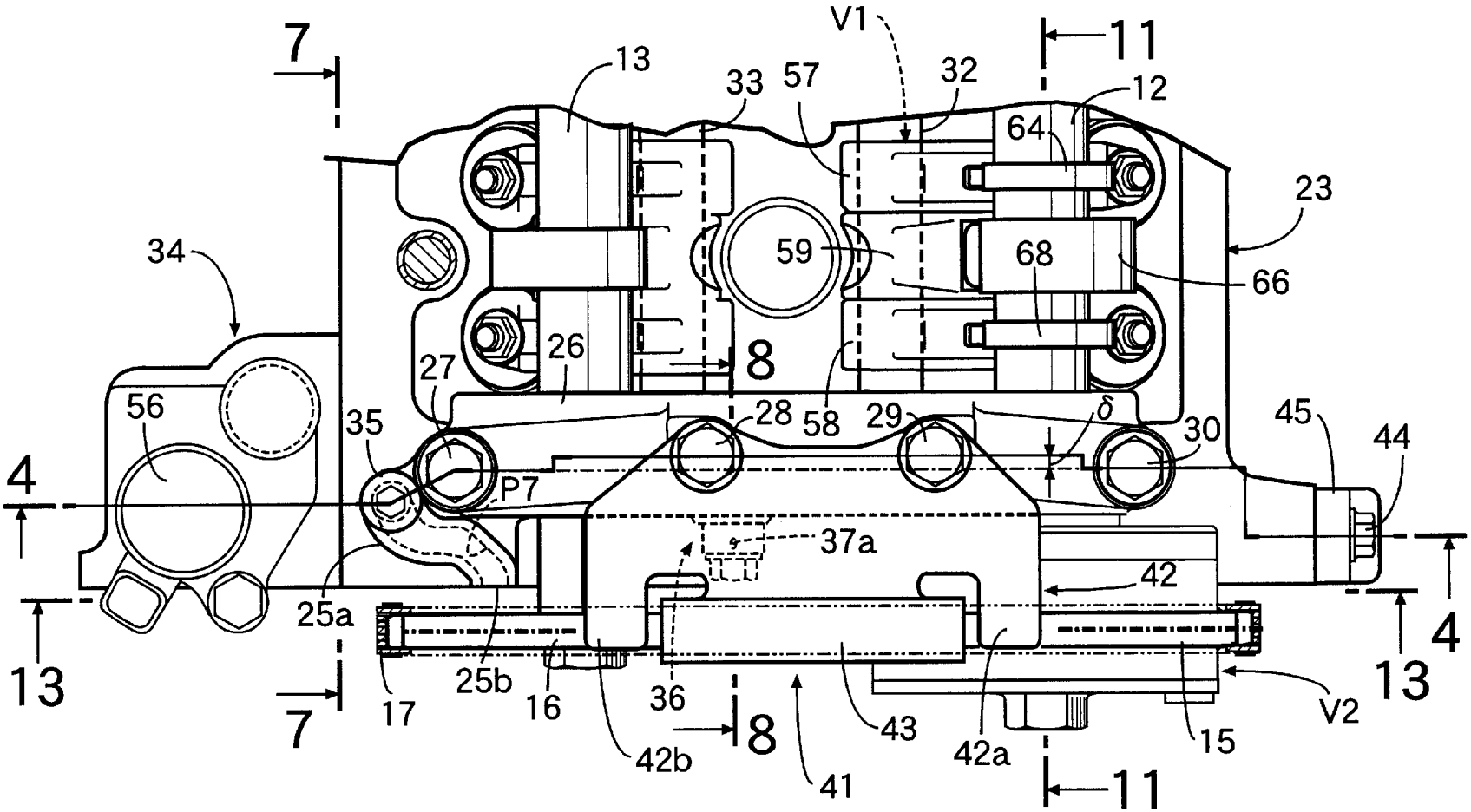
Figure 4:
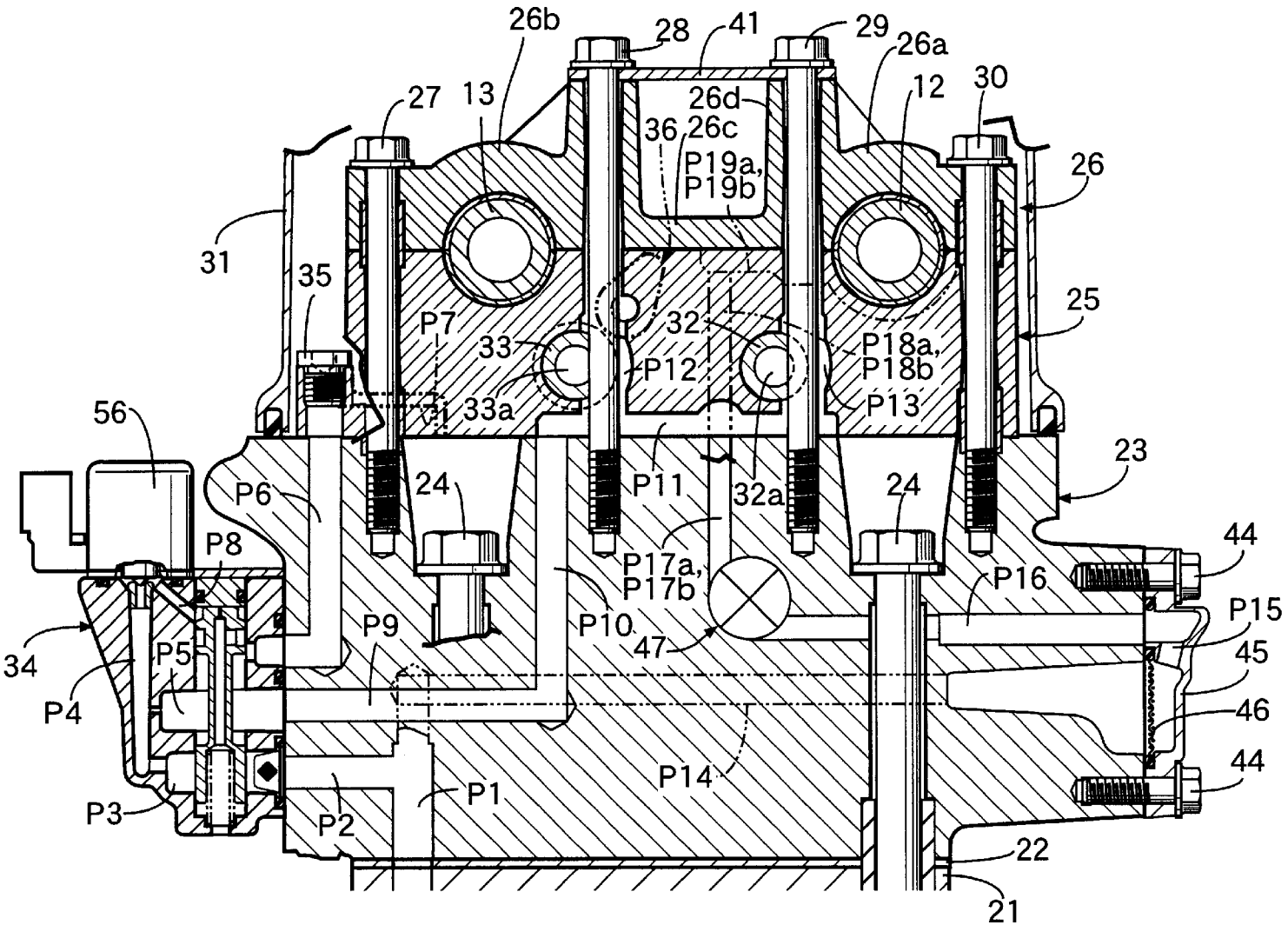

As shown in FIGS. 2 to 4, a cylinder head 23 is superposed on an upper surface of a cylinder block 21 with a gasket 22 interposed therebetween and is fastened to the upper surface by a plurality of bolts 24. A lower camshaft holder 25 and an upper camshaft holder 26 each also serving as a locker arm shaft holder are superposed on an upper surface of the cylinder head 23 and fastened together to the cylinder head 23 by four bolts 27, 28, 29 and 30. Upper portions of the lower camshaft holder 25 and the upper camshaft holder 26 are covered with a head cover 31. An intake rocker arm shaft 32 and an exhaust rocker arm shaft 33 are fixed to the lower camshaft holder 25, and the intake camshaft 12 and the exhaust camshaft 13 are rotatably carried on mating surfaces of the lower camshaft holder 25 and the upper camshaft holder 26.

Figure 5:
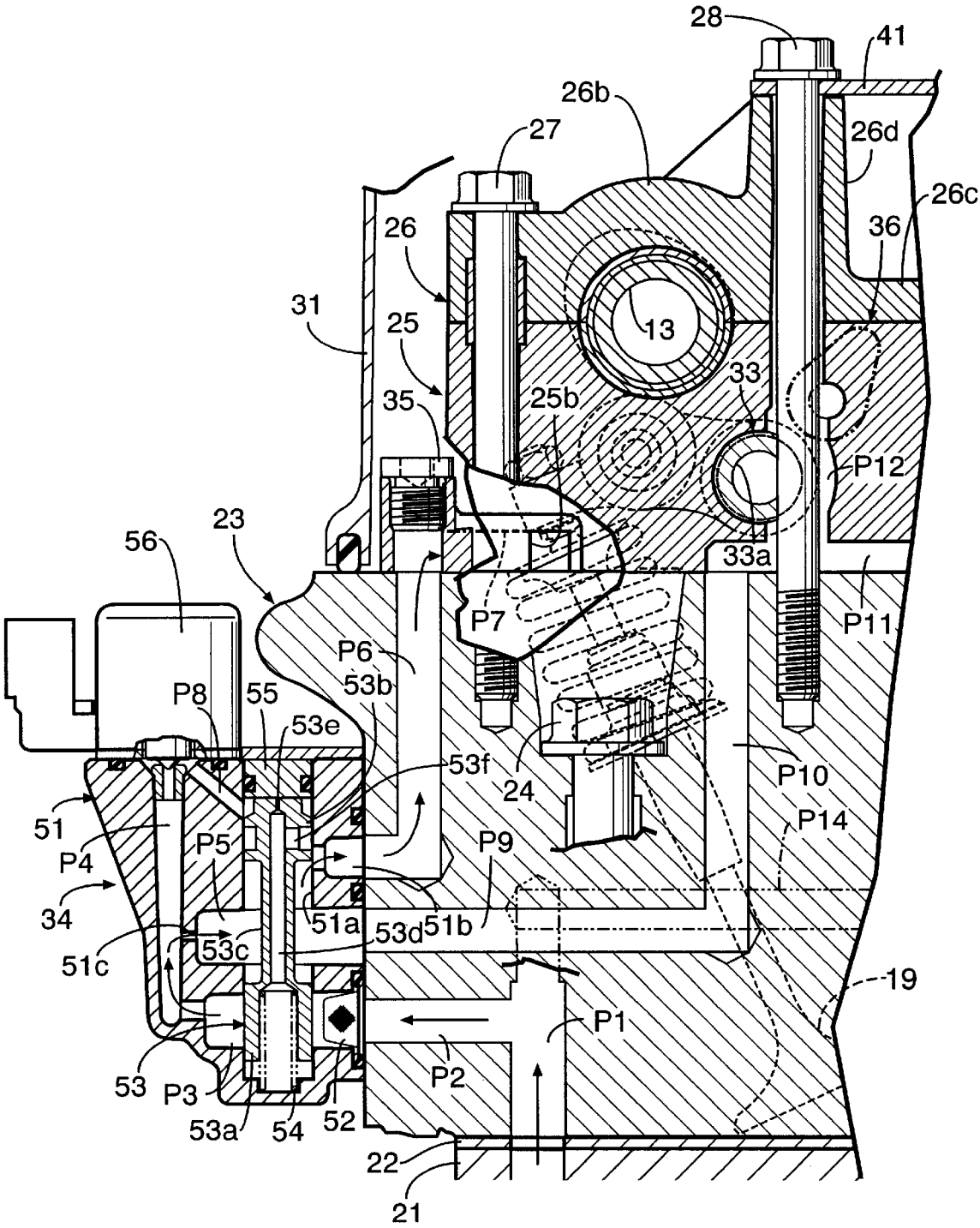
Figure 7:
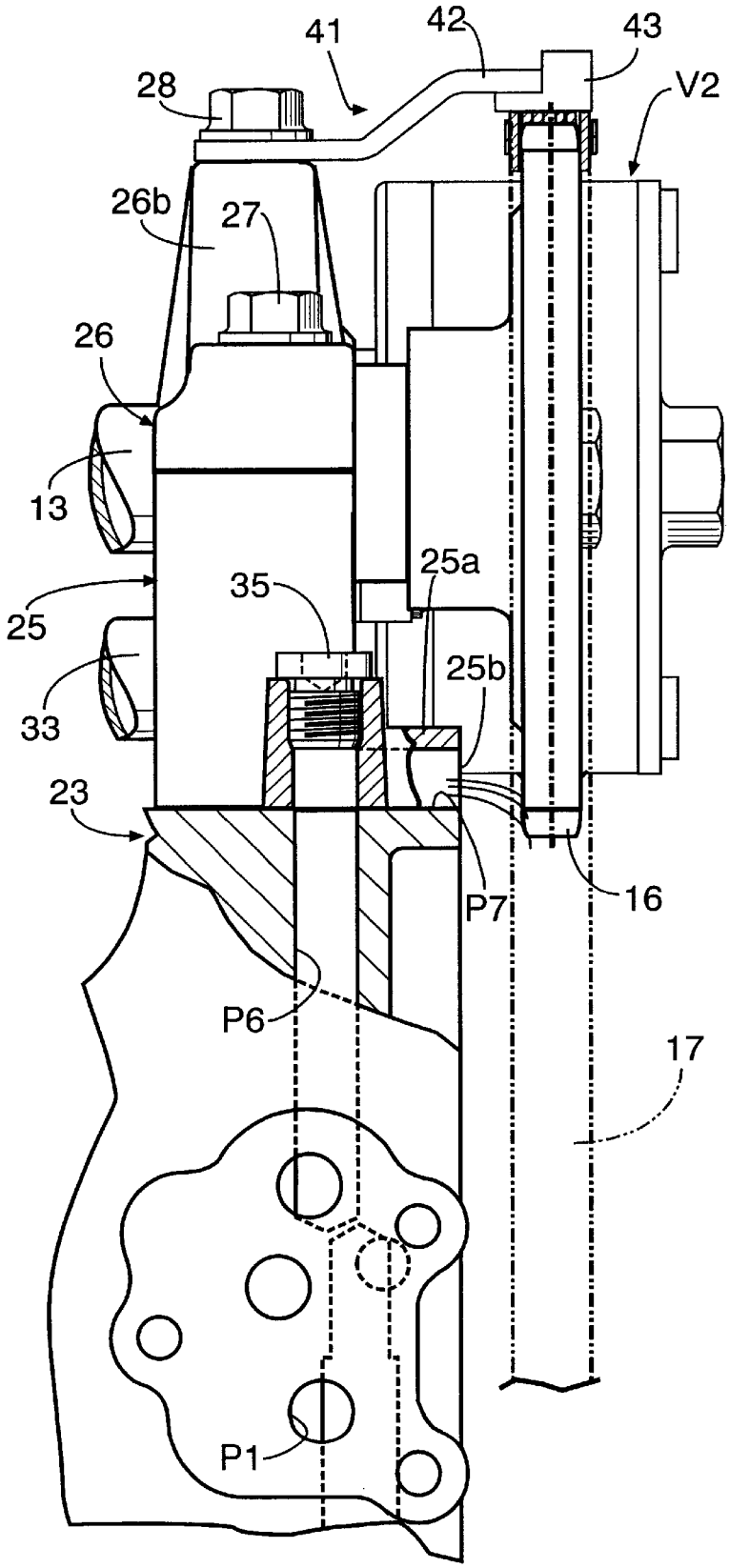

As can be seen from FIGS. 5 and 7, an oil passage P1 is defined in the cylinder head 23 and leading to an oil pump (not shown) driven by the crankshaft 11, an oil passage P2 is diverted from the oil passage P1 to communicate with a fist hydraulic pressure control valve 34 mounted on a side of the cylinder head 23. An oil passage P6 exiting the first hydraulic pressure control valve 34 into the cylinder head 23 extends upwards to communicate with an oil passage 7 defined in a lower surface (a surface mating with the cylinder head 23) of a bulge 25*a* integral with the lower camshaft holder 25. An oil drain port 25*b* is defined in a downstream end of the oil passage P7 and opposed to a zone of starting of the meshing of the exhaust camshaft sprocket 16 and the timing chain 17. The oil drain port 25*b* is narrowed slightly, as compared with a sectional area of a flow path of the oil passage P7, so that oil can be supplied reliably to the above-described meshing-starting zone. A blind plug 35 is mounted on an upper surface of a bulge 25*a* of the lower camshaft holder 25 located on an extension of an oil passage P6 extending upwards in the cylinder head 23.

An oil passage P9 exiting the first hydraulic pressure control valve 34 and extending horizontally within the cylinder head 23 communicates with an oil passage P10 extending upwards. The oil passage P10 opens into the upper surface of the cylinder head 23 and communicates with an oil passage P11 defined in a lower surface of the lower camshaft holder 25. The oil passage P11 in the lower camshaft holder 25 communicates with oil passages P12 and P13 defined around outer peripheries of two 28, 29 of the four bolts 27 to 30 for fastening the lower camshaft holder 25 and the upper camshaft holder 26 to the cylinder head 23. The oil passage P12 around the outer periphery of the bolts 28 communicates with an oil passage 33*a* defined axially in the exhaust rocker arm shaft 33, and the oil passage P13 around the outer periphery of the bolt 29 communicates with an oil passage 32*a* defined axially in the intake rocker arm shaft 32 and with an oil jet 36 provided in the lower camshaft holder 25.

Figure 8:
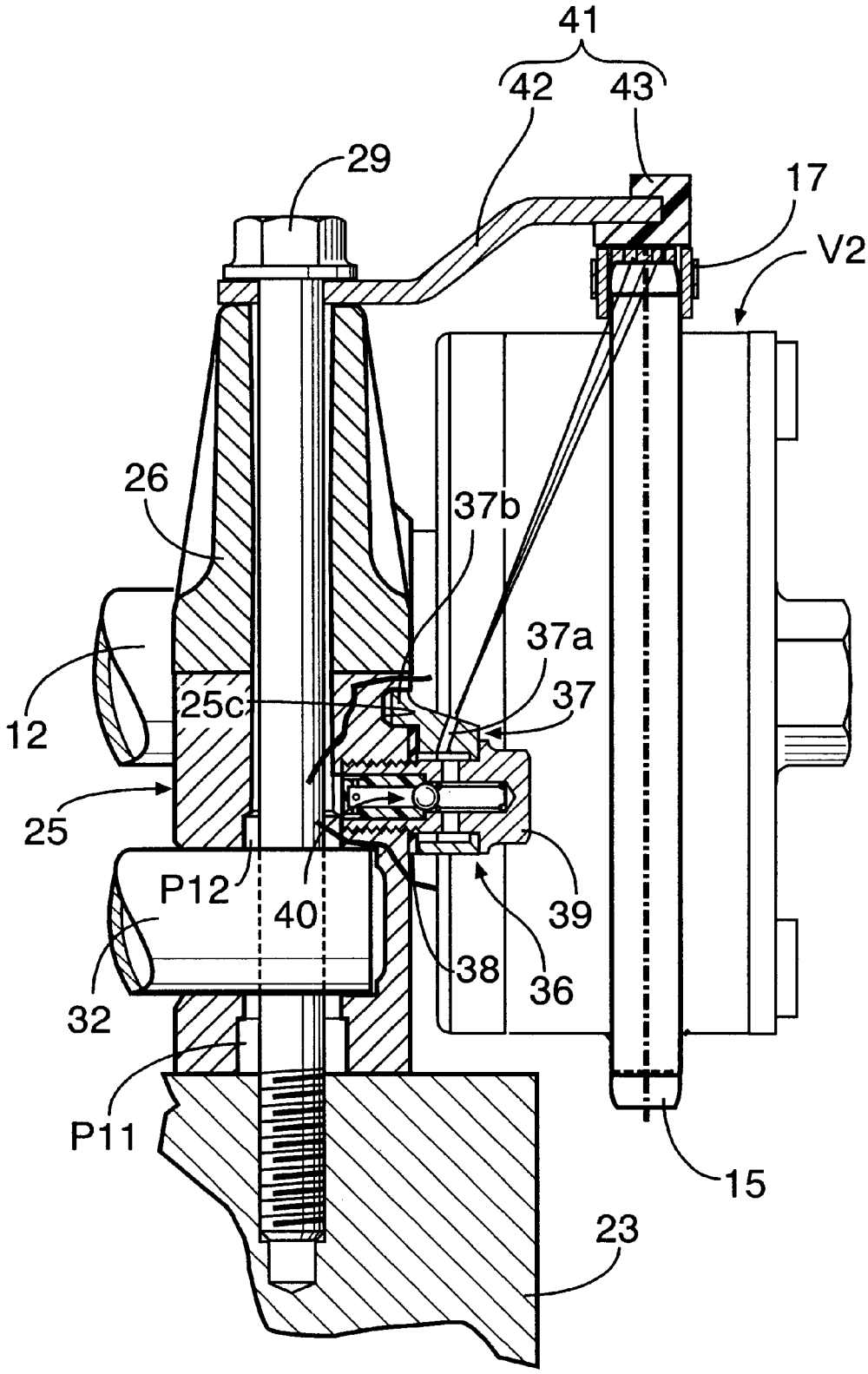

As can be seen from FIG. 8, the oil jet 36 is comprised of an oil jet body 37 having a nozzle bore 37*a*, and a mounting bolt 39 for fixing the oil jet body 37 to the lower camshaft holder 25 with a seal member 38 interposed therebetween. A relief valve 40 is accommodated within the mounting bolt 39, so that its upstream portion communicates with the oil passage P12 around the outer periphery of the bolt 28, and its downstream portion communicates with the nozzle bore 37*a* in the oil jet body 37. By fitting a positioning projection 37*b* formed on the oil jet body 37 into a positioning bore 25*c* defined in the lower camshaft holder 25, the oil jet 36 is positioned so that the nozzle bore 37*a* points to the zone of starting of the meshing of the intake camshaft sprocket 15 and the timing chain 17.

The oil jet 36 is disposed in a dead space defined between the lower camshaft holder 25 and the exhaust camshaft sprocket 16, so that it is fallen into an outside diameter of the exhaust camshaft sprocket 16 and hence, the influence exerted by the mounting of the oil jet 36 to other members can be suppressed to the minimum. Particularly, the oil jet 36 is disposed by effectively utilizing a dead space on a back of the exhaust camshaft sprocket 16, which is not occupied by the second valve-operating characteristic changing mechanism V2. Therefore, it is possible to suppress an increase in size of the engine E and the obstruction of the mounting of the other members due to the mounting the oil jet 36 to the minimum. As shown in FIG. 2, a lightening bore 16*a* made in the exhaust camshaft sprocket 16 for reducing the weight thereof is opposed to the oil jet 36. In other words, the oil jet 36 is provided to face the lightening bore 16*a* made in the exhaust camshaft sprocket 16 and hence, the mounted state of the oil jet 36 and the forgetting to mount the oil jet 36 can be checked easily through the lightening bore 16*a*.

If the entire mounting bolt 39 of the oil jet 36 is disposed within a region of the lightening bore 16*a* in the exhaust camshaft sprocket 16, the mounting bolt 39 can be removed through the lightening bore 16*a*, leading to an enhanced maintenance. If the entire oil jet 36 is disposed within a region of the lightening bore 16*a* in the exhaust camshaft sprocket 16, the oil jet 36 can be removed through the lightening bore 16*a*, leading to an enhanced maintenance.

As can be seen from FIGS. 3, 4 and 8, a chain guide 41 is fastened by the two bolts 28 and 29 for fastening the upper camshaft holder 26 (the inner bolts disposed inside the intake camshaft 12 and the exhaust camshaft 13). The two bolts 28 and 29 for fastening the upper camshaft holder 26 are offset by a distance δ in a direction away from the oil jet 36 with respect to the two bolts 27 and 30 disposed outside the bolts 28 and 29. Thus, it is possible to avoid the interference with the bolts 28 and 29 to secure the mounting space for the oil jet 36 and moreover to enhance the support rigidity of the oil jet 36.

One of the two offset bolts 28 and 29 is overlapped on the oil jet 36 as viewed in an axial direction of the exhaust camshaft 13 and hence, it is possible not only to reduce the size of the lower camshaft holder 25, but also to enhance the support rigidity of the exhaust camshaft 13. The reason is that if the oil jet 36 is disposed at a location closer to the bolts 29 than the bolt 28 (i.e., at a location farther from the exhaust camshaft 13), the size of the lower camshaft holder 25 is increased by a value corresponding to the space for the oil jet 36. On the other hand, if the oil jet 36 is disposed at a location displaced from the bolt 28 toward the exhaust camshaft 13, it is necessary to define a mounting bore for the oil jet 36 at a location closer to the surface of the lower camshaft holder 25 supporting the exhaust camshaft 13 and for this reason, there is a possibility that the support rigidity of the exhaust camshaft 13 is reduced. Further, the oil passage P12 is defined around the periphery of the bolt 28 to communicate with the oil jet 36 and hence, an oil passageway for supplying oil to the oil jet 36 can be simplified in arrangement and shortened.

The chain guide 41 includes a chain guide body 42 formed of a metal plate, and a slide member 43 made of a synthetic resin is mounted on an upper surface of a tip end of the chain guide body 42 to come into contact with the upper surface of the timing chain 17 for sliding movement. The timing chain 17 can be guide by the slide member 43 with its deflection inhibited, whereby the occurrence of the wear of the timing chain 17 can be inhibited, and the resistance to the sliding movements of the chain guide 41 and the timing chain 17 can be reduced. A pair of skip-preventing plates 42*a* and 42*b* are integrally formed at lengthwise opposite ends of the chain guide body 42. One of the skip-preventing plates 42*a* covers the above of the zone of starting of the meshing between the intake camshaft sprocket 15 and the timing chain 17 to prevent the skipping of the timing chain 17, and the other skip-preventing plate 42*b* covers the above of a zone of finishing of the meshing between the intake camshaft sprocket 15 and the timing chain 17 to prevent the skipping of the timing chain 17. The rigidity of the chain guide 41 is enhanced by the provision of the skip-preventing plates 42*a* and 42*b* and hence, the support rigidities of the intake camshaft 12 and the exhaust camshaft 13 are also further enhanced.

Since the skip-preventing plates 42*a* and 42*b* are formed at opposite ends of the slide member 43 made of the synthetic resin and hence, the durability of the slide member 43 is enhanced, notwithstanding that the slide member 43 is made of the synthetic resin.

The upper camshaft holder 26 includes a cam cap portion 26*a* adapted to hold the intake camshaft 12, a cam cap portion 26*b* adapted to hold the exhaust camshaft 13, and a connecting wall portion 26*c*, which connects the cam cap portions 26*a* and 26*b* to each other. A U-shaped lightening recess 26*d* is formed between the two bolts 28 and 29 and the connecting wall portion 26*c*, i.e., in a surface of the connecting wall portion 26*c* opposed to the chain guide 41. The cam cap portions 26*a* and 26*b* are connected at their lower ends to each other by the connecting wall portion 26*c* and also at their upper ends to each other by the chain guide 41. Namely, the chain guide 41 is bridged over the recess 26*d* formed between the cam cap portions 26*a* and 26*b* and the connecting wall portion 26*c* and hence, it is possible to couple the cam cap portions 26*a* and 26*b* by the connecting wall portion 26*c* and the chain guide 41, while lightening the upper camshaft holder 26, thereby ensuring a sufficient rigidity and enhancing the support rigidity of the intake camshaft 12 and the exhaust camshaft 13.

As described above, the chain guide 41 is fastened utilizing two 28 and 29 of the four bolts 27 to 30 for fastening the lower camshaft holder 25 and the upper camshaft holder 26 to the cylinder head 23 and hence, the number of parts is reduced and moreover, the mounted rigidity of the chain guide 41 is enhanced. In addition, the level of the seat faces of the two inner bolts 28 and 29 for fixing the chain guide 41 is restrained to the level of the timing chain 17, but the level of the seat faces of the two outer bolts which do not contribute to the fixing of the chain guide 41 can be lowered without being restrained to the level of the timing chain 17. Thus, the opposite ends of the upper camshaft holder 26 can be disposed at a level lower than the seat faces of the bolts 28 and 29 to reduce the size of the head cover 31.

Returning to FIG. 4, a filter housing 45 is fixed to a side of the cylinder head 23 by bolts 44, and an oil passage P14 diverted from the oil passage P1 in the cylinder head 23 extends in a direction away from the first valve-operating characteristic changing mechanism V1 and via a filter 46 within the filter housing 45 and an oil passage P15 to communicate with an oil passage P16 in the cylinder head 23. The oil passage P16 communicates with the second valve-operating characteristic changing mechanism V2 accommodated in the cylinder head 23 (in an end wall of the cylinder head 23 on the side of the timing chain 17, and a second hydraulic pressure control valve 47 communicates with an outer periphery of the intake camshaft 12 through oil passages P17*a* and P17*b* defined in the cylinder head 23 and oil passages P18*a*, P18*b*; P19*a* and P19*b* defined in the lower camshaft holder 25. The filter housing 45 is mounted utilizing the space on the side of the cylinder head 23 opposite from the side of the cylinder head 23 on which the first hydraulic pressure control valve 34 is mounted.

The structure of the first hydraulic pressure control valve 34 will be described below with reference to FIG. 5.

The first hydraulic pressure control valve 34 mounted on the side of the cylinder head 23 includes a valve bore 51*a* defined in the valve housing 51. Opposite ends of an oil passage P3 extending through a lower portion of the valve bore 51*a* communicate with the oil passage P2 and an oil passage P4, respectively, and opposite ends of an oil passage P5 extending through an intermediate portion of the valve bore 51*a* communicate with the oil passages P9 and P4, respectively. An upper portion of the valve bore 51*a* communicates with the oil passage P6 through a drain port 51*b*. A filter 52 is mounted in an inlet of the oil passage P3. Defined in a spool 53 accommodated in the valve bore 51*a* are a pair of lands 53*a* and 53*b*, a groove 53*c* between the lands 53*a* and 53*b*, an internal bore 53*d* extending axially, an orifice 53*e* extending through an upper end of the internal bore 53*d*, and a groove 53*f* permitting the internal bore 53*d* to communicate with the drain port 51*b*. The spool 53 is biased upwards by a spring 54 accommodated in a lower end of the internal bore 53*d* to abut against a cap 55 which closes an upper end of the valve bore 51*a*. The oil passages P4 and P5 communicate with each other through the orifice 51*c*. The oil passage P4 and an oil passage P8 are connected to and disconnected from each other by an ON/OFF solenoid 56.

The structure of the first valve-operating characteristic changing mechanism V1 will be described below with reference to FIG. 9.

The first valve-operating characteristic changing mechanism V1 adapted to drive the intake valves 18, 18 includes first and second low-speed rocker arms 57 and 58 pivotally supported on the intake rocker arm shaft 32 for swinging movement, and a high-speed rocker arm 59 mounted between the low-speed rocker arms 57 and 58. Sleeves 60, 61 and 62 are press-fitted into intermediate portions of the rocker arms 57, 58 and 59, respectively. A roller 63 rotatably carried on the sleeve 60 abuts against a low-speed intake cam 64 provided on the intake camshaft 12; a roller 65 rotatably carried on the sleeve 61 abuts against a high-speed intake cam 66 provided on the intake camshaft 12; and a roller 67 rotatably carried on the sleeve 62 abuts against a low-speed intake cam 68 provided on the intake camshaft 12. The height of the lobe of the high-speed cam 66 is set larger than those of the lobes of a pair of the low-speed intake cams having the same profile.

A first switching pin 69, a second switching pin 70 and a third switching pin 71 are slidably supported within the three sleeves 60, 61 and 62, respectively. The first switching pin 69 is biased toward the second switching pin 70 by a spring 73 disposed in a compressed state between the first switching pin 69 and a spring seat 72 fixed to the sleeve 60, and is stopped at a location where it abuts against a clip 74 fixed to the sleeve 60. At this time, abutment faces of the first and second switching pins 69 and 70 are located between the first low-speed rocker arm 57 and the high-speed rocker arm 59, and abutment faces of the second and third switching pins 70 and 71 are located between the high-speed rocker arm 59 and the second low-speed rocker arm 58. An oil camber 58*a* defined in the second low-speed rocker arm 58 communicates with an oil passage 32*a* defined in the intake rocker arm shaft 32.

Figure 9:
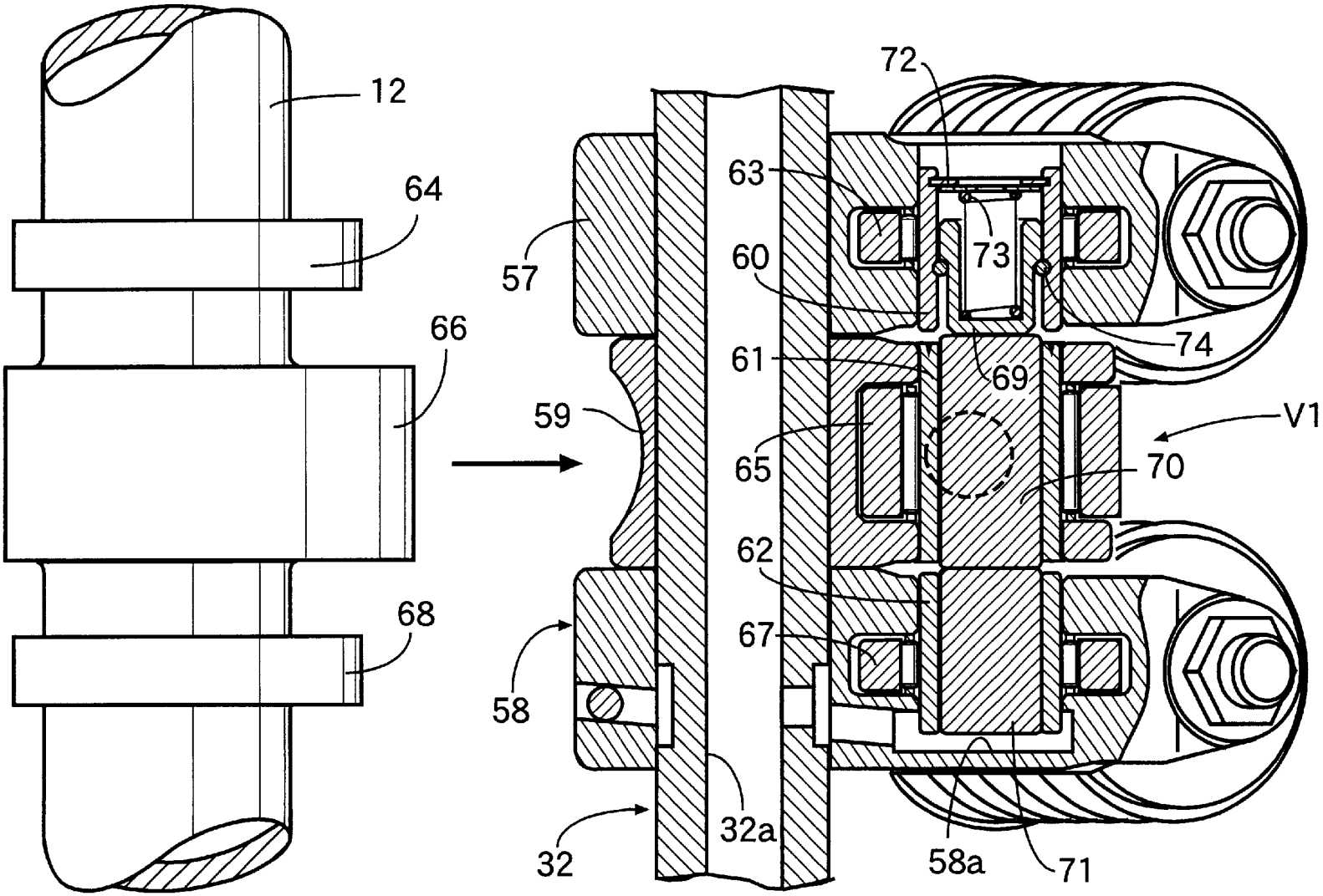

When no hydraulic pressure is applied to the oil passage 32*a* in the intake rocker arm shaft 32, the first, second and third switching pins 69, 70 and 71 are in positions shown in FIG. 9, and the first and second low-speed rocker arms 57 and 58 and the high-speed rocker arm 59 are freely swingable. Therefore, the pair of intake valves 18, 18 are driven with a low valve lift by the first and second low-speed rocker arms 57 and 58, respectively. At this time, the high-speed rocker arm 59 disconnected from the first and second low-speed rocker arms 57 and 58 is raced independently of the pair of intake valves 18, 18.

When a hydraulic pressure is applied to the oil camber 58*a* from the oil passage 32*a* in the intake rocker arm shaft 32, the first, second and third switching pins 69, 70 and 71 are moved against the force of the spring 73, whereby the first and second low-speed rocker arms 57 and 58 and the high-speed rocker arm 59 are integrally connected together. As a result, the first and second low-speed rocker arms 57 and 58 and the high-speed rocker arm 59 are driven in unison by the high-speed intake cam 66 having the higher lobe, and the pair of intake valves 18, 18 connected to the first and second low-speed rocker arms 57 and 58 are driven with a higher valve lift. At this time, the air of low-seed intake cams 64 and 68 are separated from the first and second low-speed rocker arms 57 and 58 and raced.

The structure of the second hydraulic pressure control valve 47 will be described below with reference to FIG. 10.

Five ports 82, 83, 84, 85 and 86 are defined in a cylindrical valve housing 81 fitted in the valve bore 23*a* made in the cylinder head 23. The central port 84 communicates with an oil passage P16; the ports 83 and 85 on opposite sides of the central port 84 communicate with a pair of oil passages P17*a* and P17*b*, respectively, and the ports 82 and 86 on opposite sides of the central port 84 communicate with a pair of draining oil passages P20*a* and P20*b*, respectively. A spool 90 having three grooves 87, 88 and 89 defined in its outer periphery is slidably received in the valve housing 81 and biased by a resilient force of a spring 91 mounted at one end of the spool 90 toward a linear solenoid 92 mounted at the other end of the spool 90.

Figure 10:
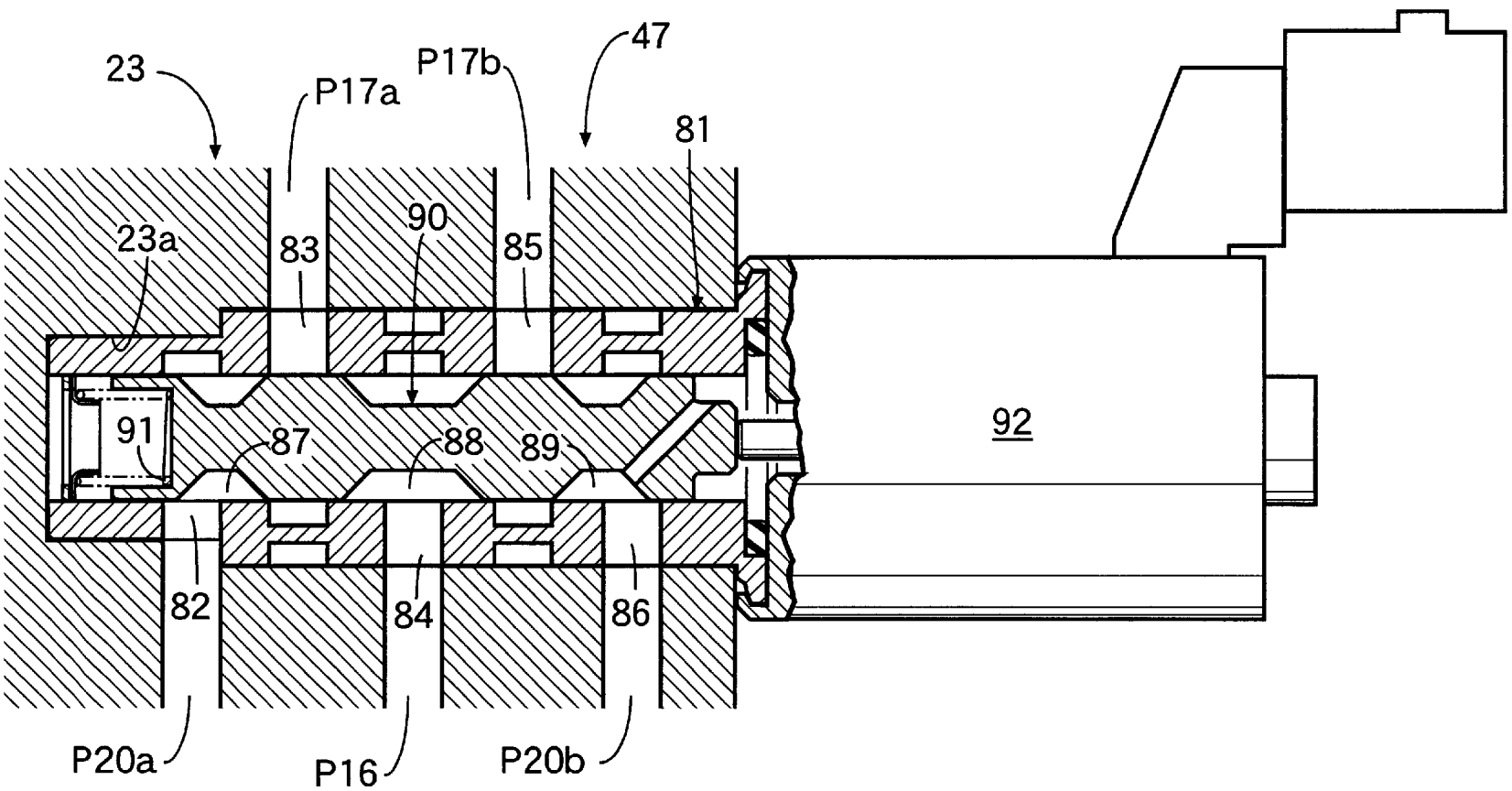

When the spool 90 is in a neutral position shown in FIG. 10, all the oil passages P16, P17*a* and P17*b* are closed. When the spool 90 is moved leftwards from the neutral position by the duty-controlled linear solenoid 92, the oil passage P16 is brought into communication with the oil passage P17*a* through the port 84, the groove 88 and the port 83, and the oil passage P17*b* is brought into communication with the oil passage P20*b* through the port 85, the groove 89 and the port 86. When the spool 90 is moved rightwards from the neutral position by the duty-controlled linear solenoid 92, the oil passage P16 is brought into communication with the oil passage P17*b* through the port 84, the groove 88 and the port 85, and the oil passage P17*a* is brought into communication with the oil passage P20*a* through the port 83, the groove 87 and the port 82.

The structure of the second valve-operating characteristic changing mechanism V2 will be described below with reference to FIGS. 11 and 12.

The second valve-operating characteristic changing mechanism V2 includes an outer rotor 93, and an inner rotor 96 fixed to the intake camshaft 12 by a pin 94 and bolts 95. The outer rotor 93 includes a cup-shaped housing 97, on an outer periphery of which the intake camshaft sprocket 15 is integrally formed, an outer rotor body 98 fitted into the housing 97, and an annular cover plate 99 which covers an opening in the housing 97. The housing 97, the outer rotor body 98 and the cover plate 99 are integrally coupled to one another. A support bore 97*a* is made in the center of the housing 97, so that the outer rotor 93 is relatively rotatably supported on the intake camshaft 12 by fitting of the support bore 97*a* over an outer periphery of the intake camshaft 12.

Four recesses 98*a* and four projections 98*b* are formed alternately around an inner periphery of the outer rotor body 98, and four vanes 96*a* radiately formed around an outer periphery of the inner rotor 96 are fitted into the four recesses 98*a*, respectively. Seal members 101 are mounted at tip ends of the projections 98*b* of the outer rotor body 98 to abut against the inner rotor 96, and seal members 102 are mounted at tip ends of the vanes 96*a* of the inner rotor 96 to abut against the outer rotor body 98, whereby four advance chambers 103 and four delay chambers 104 are demarcated between the outer rotor body 98 and the inner rotor 96.

A stopper pin 105 is slidably supported in a pinhole 96*b* provided in the inner rotor 96, and an arcuate elongated groove 97*b* is provided in the housing 97 of the outer rotor 93, so that a tip end of the stopper pin 105 can be brought into engagement in the elongated groove 97*b*. The stopper pin 105 is biased in a direction away from the elongated groove 97*b* by a spring 106, and an oil chamber 107 is defined behind the stopper pin 105. When the stopper pin 105 is in a state in which it has been moved away from the elongated groove 97*b* by a repulsing force of a spring 106, the outer rotor 93 and the inner rotor 96 can be rotated relative to each other within an angle $\alpha$ (e.g., 30°) until each of the vanes 96*a* of the inner rotor 96 is moved from one end of each recess 98*a* in the outer rotor 93 to reach to the other end of the recess 98*a*. When a hydraulic pressure is supplied to the oil chamber 107 to bring the stopper pin 105 into engagement in the elongated groove 97*b*, the outer rotor 93 and the inner rotor 96 can be rotated relative to each other within an angle $\beta$ (e.g., 20°) until the stopper pin 105 is moved from one end of the elongated groove 97*b* to reach the other end of the elongated groove 97*b*.

The pairs of oil passages P18*a*, P18*b*; P19*a*, P19*b* defined in the lower camshaft holder 25 communicate with the advance chambers 103 and the delay chambers 104 through a pair of oil passages 12*a* and 12*b* defined in the intake camshaft 12 and oil passages 96*c* and 96*d* defined in the inner rotor 96, respectively. Therefore, when a hydraulic pressure is supplied to the advance chambers 103 through the second hydraulic pressure control valve 47, the low-speed intake cams 64 and 68 and the high-speed intake cam 66 are advanced relative to the intake camshaft 12 to hasten the timing of the intake valves 18, 18. When a hydraulic pressure is supplied to the delay chambers 104 through the second hydraulic pressure control valve 47, the low-speed intake cams 64 and 68 and the high-speed intake cam 66 are delayed to retard the timing the intake valves 18, 18.

An oil passage P21 is defined in the second lower camshaft holder 25 as viewed from the side of the second valve-operating characteristic changing mechanism V2 to communicate with the oil passage P13 (see FIG. 4). The oil passage P21 communicates with the oil chamber 107 facing a head of the stopper pin 105 through an oil passage 12*c* defined in the intake camshaft 12 and oil passages 95*a* and 95*b* defined in the bolt 95.

In the present embodiment, no valve-operating characteristic changing mechanism is mounted on the exhaust camshaft 13, and the exhaust valves 19, 19 are driven with a medium valve lift. In other words, the valve lift of the exhaust valves 19, 19 is medium between a valve lift (a smaller lift) provided when the intake valves 18, 18 are moved at a lower speed and a valve lift (a larger lift) provided when the intake valves 18, 18 are moved at a higher speed.

The operation of the embodiment having the above-described arrangement will be described below.

During rotation of the engine E at a lower speed, the solenoid 56 of the first hydraulic pressure control valve 34 is in its turned-off state and hence, the communication between the oil passages P4 and P8 is cut off, and the spool 53 is in its lifted position shown in FIG. 5 under the action of the repulsing force of the spring 54. In this state, the oil pump communicates with the oil chamber in the first valve-operating characteristic changing mechanism V1 via the oil passages P1 and P2 in the cylinder head 23, the oil passages P3 and P4, the orifice 53*c* and the oil passage P5 in the valve housing 51, the oil passages P9 and P10 in the cylinder head 23, the oil passages P11 and P13 in the lower camshaft holder 25 and the oil passage 32*a* in the intake rocker arm shaft 32. At this time, the hydraulic pressure transmitted to the oil chamber 58*a* in the first valve-operating characteristic changing mechanism V1 is brought into a lower pressure by the action of the orifice 53*c* in the first hydraulic pressure control valve 34. Therefore, the first, second and third switching pins 69, 70 and 71 are retained in the positions shown in FIG. 9, and the pair of intake valves 18, 18 are driven with the lower valve lift, and a valve operating system (including a rocker arm support portion, a camshaft support portion and the like) can be lubricated by the oil having the lower pressure.

Figure 11:
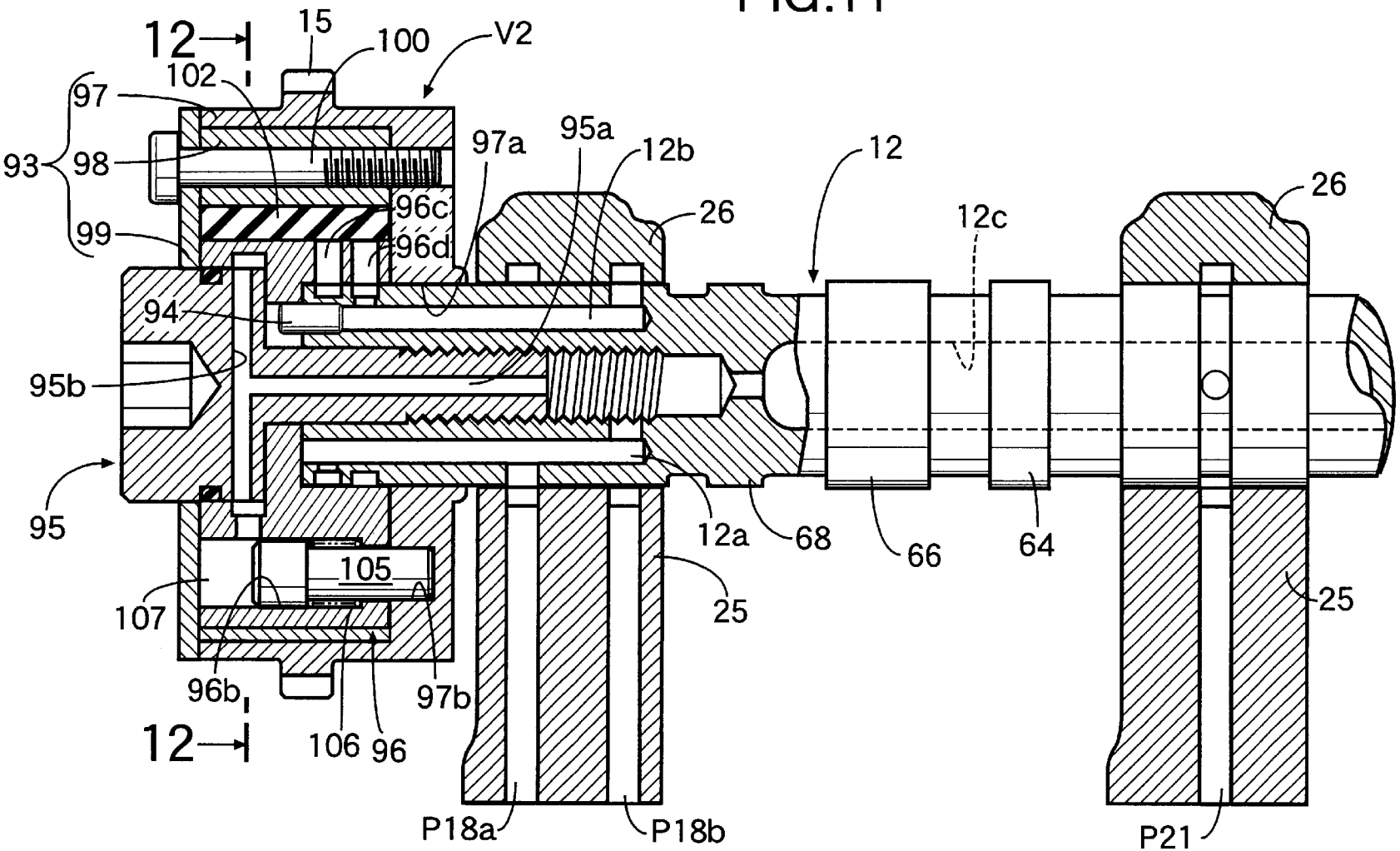
Figure 12:
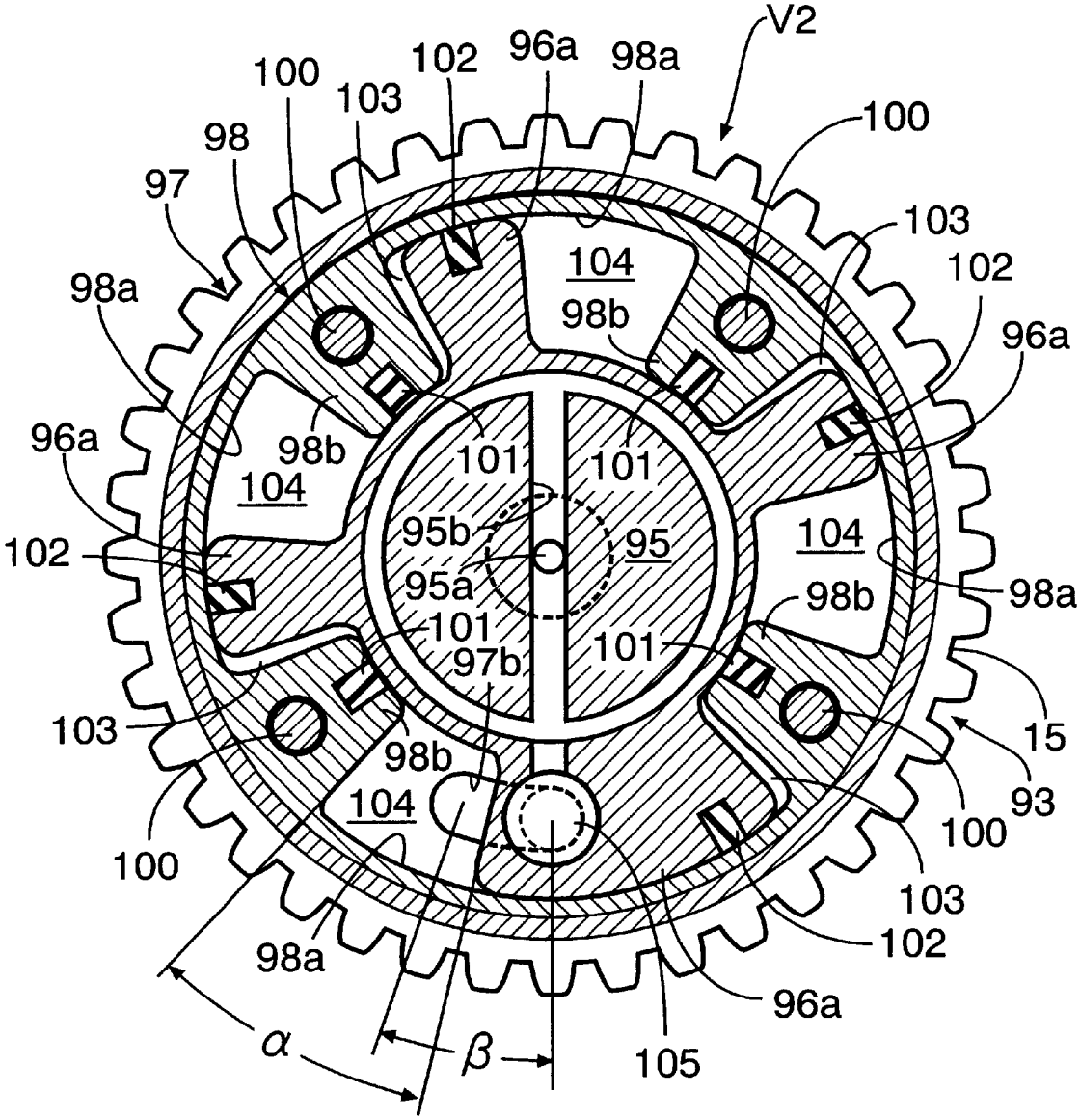
Figure 13:
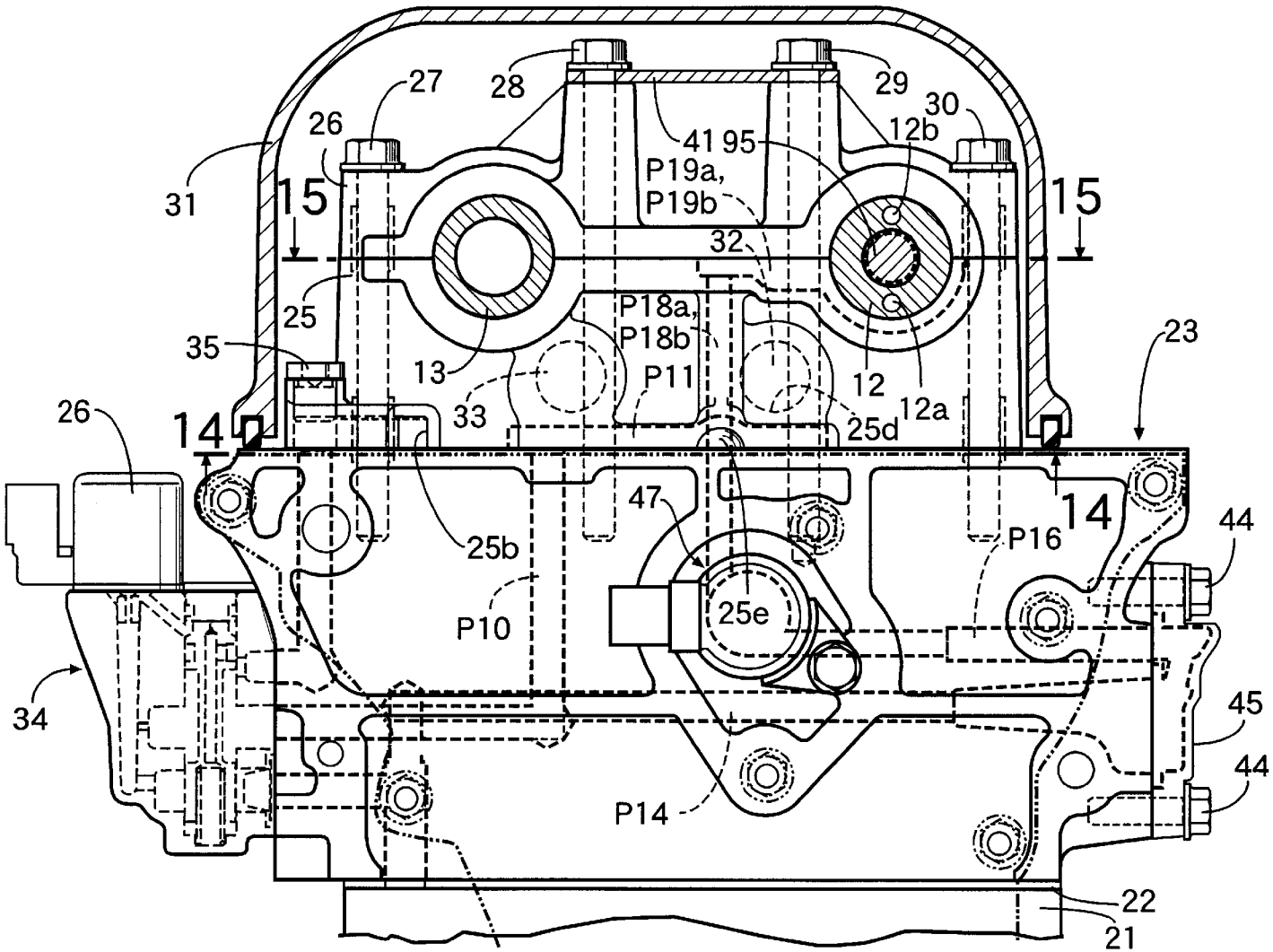
Figure 14:
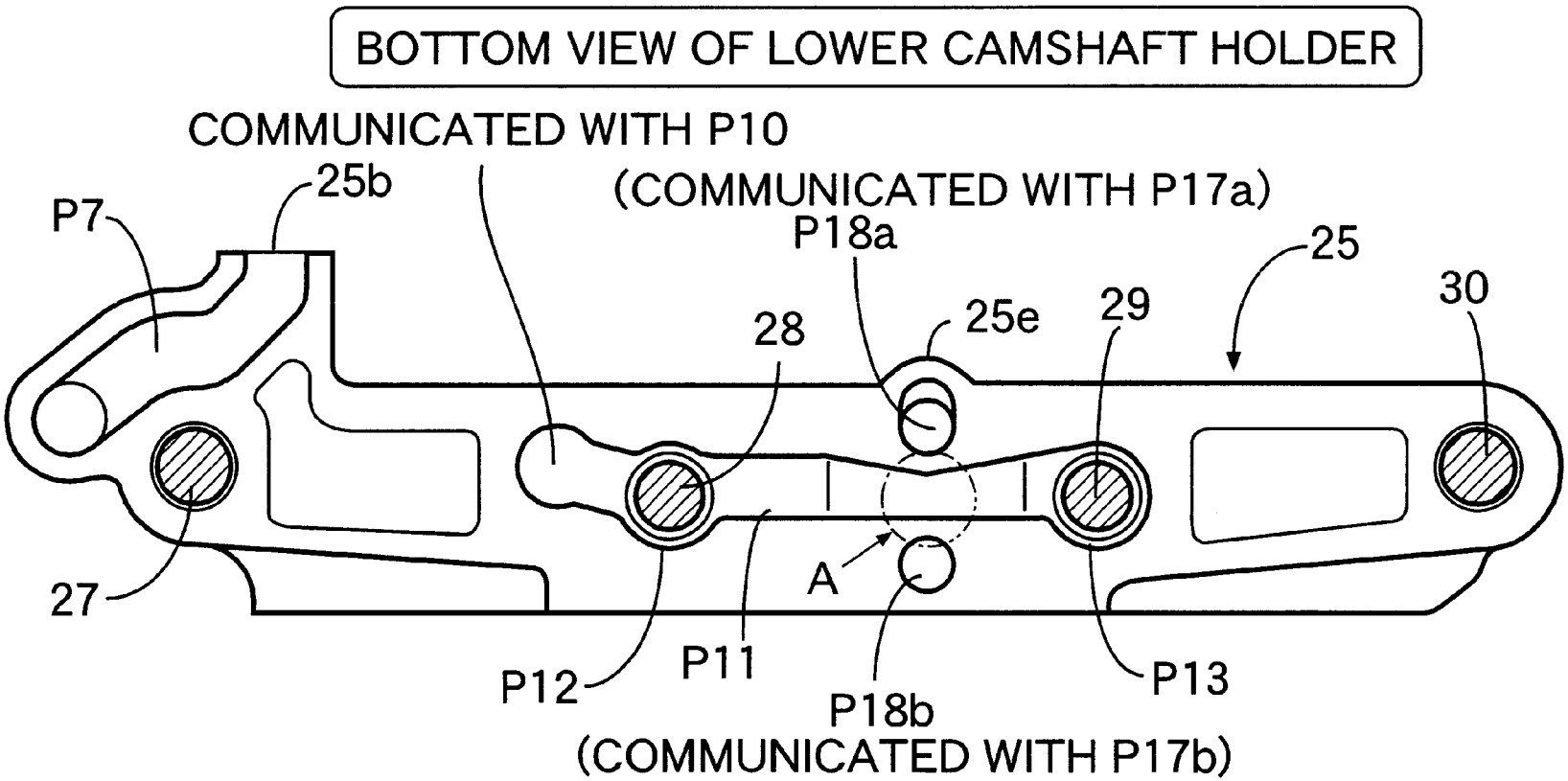

When the hydraulic pressure output from the first hydraulic pressure control valve 34 is lower, as described above, the hydraulic pressure transmitted to the oil chamber 107 in the second valve-operating characteristic changing mechanism V2 through the oil passage P21 in the lower camshaft holder 25 and the oil passage 12*c* in the intake camshaft 12 shown in FIG. 11 is also brought into a lower pressure, and the stopper pin 105 is moved away from the elongated groove 97 by the repulsing force of the spring 106. When the duty ratio of the second hydraulic pressure control valve 47 (see FIG. 10) connected to the oil pump through the oil passages P1 and P14 in the cylinder head 23, the oil passage P15 in the filter housing 45 and the oil passage P16 in the cylinder head 23 is controlled, a difference is generated between the hydraulic pressures transmitted to the advance chambers 103 and the delay chambers 104 in the second valve-operating characteristic changing mechanism V2 through the pair of oil passages P17*a* and P17*b*. As a result, the phase of the inner rotor 96 relative to the outer rotor 93 can be changed within the angle $\alpha$ (see FIG. 12), thereby controlling the valve timing of the intake valves 18, 18.

During the rotation of the engine at the lower speed described above, the oil passed through the orifice 53*c* in the first hydraulic pressure control valve 34 to have a reduced pressure (i.e., the relieved oil) flows via the oil passage P5, the groove 53*c* in the spool 53, the drain port 51*b*, the oil passage P6 in the cylinder head 23 and the oil passage P7 in the bulge 25*a* of the lower camshaft holder 25 and through the oil drain port 25*b* to the zone of starting of the meshing of the exhaust camshaft sprocket 16 and the timing chain 17 (or a meshed zone between the exhaust camshaft sprocket 16 and the timing chain 17), thereby lubricating the timing chain 17 (see FIG. 7). During the rotation of the engine at the lower speed, the rotational speed of the timing chain 17 is also smaller and hence, the oil deposited to the timing chain 17 is scattered in a reduced amount by a centrifugal force. Therefore, if the oil is supplied to the zone of starting of the meshing of the exhaust camshaft sprocket 16 and the timing chain 17 on the delayed side in a direction of rotation of the timing chain 17, the meshed zone between the exhaust camshaft sprocket 16 and the timing chain 17 on the advanced side in the direction of rotation of the timing chain 17 can be also lubricated sufficiently, because the engine E is in a state in which it is being rotated at the lower speed, and the load of the timing chain 17 is smaller.

The relived oil from the first hydraulic pressure control valve 34 is permitted to flow out of the oil drain port 25*b* to lubricate the timing chain 17, as described above, and hence, an oil jet and a space for mounting of the oil jet are not required. Moreover, the oil passage P7 leading to the oil drain port 25*b* is defined in the mating surfaces of the cylinder head 23 and the lower camshaft holder 25 and hence, the arrangement of the oil passage P7 is simplified. In addition, the first hydraulic pressure control valve 34 is mounted to a sidewall of the cylinder head 23 closer to the oil drain port 25*b* and hence, as compared with a case where the first hydraulic pressure control valve 34 is mounted to a sidewall of the cylinder head 23 farther from the oil drain port 25*b*, the length of the oil passage P7 for the relieved oil can be reduced, and the mounted rigidity of the first hydraulic pressure control valve 34 is also increased.

Further, the first hydraulic pressure control valve 34 and the oil passage P7 for the relieved oil defined in the mating surfaces of the cylinder head 23 and the lower camshaft holder 25 are disposed on the same plane perpendicular to the camshafts 12 and 13 and hence, the lengths of the oil passages P6 and P7 from the first hydraulic pressure control valve 34 to the oil drain port 25*b* can be further reduced.

Figure 6:
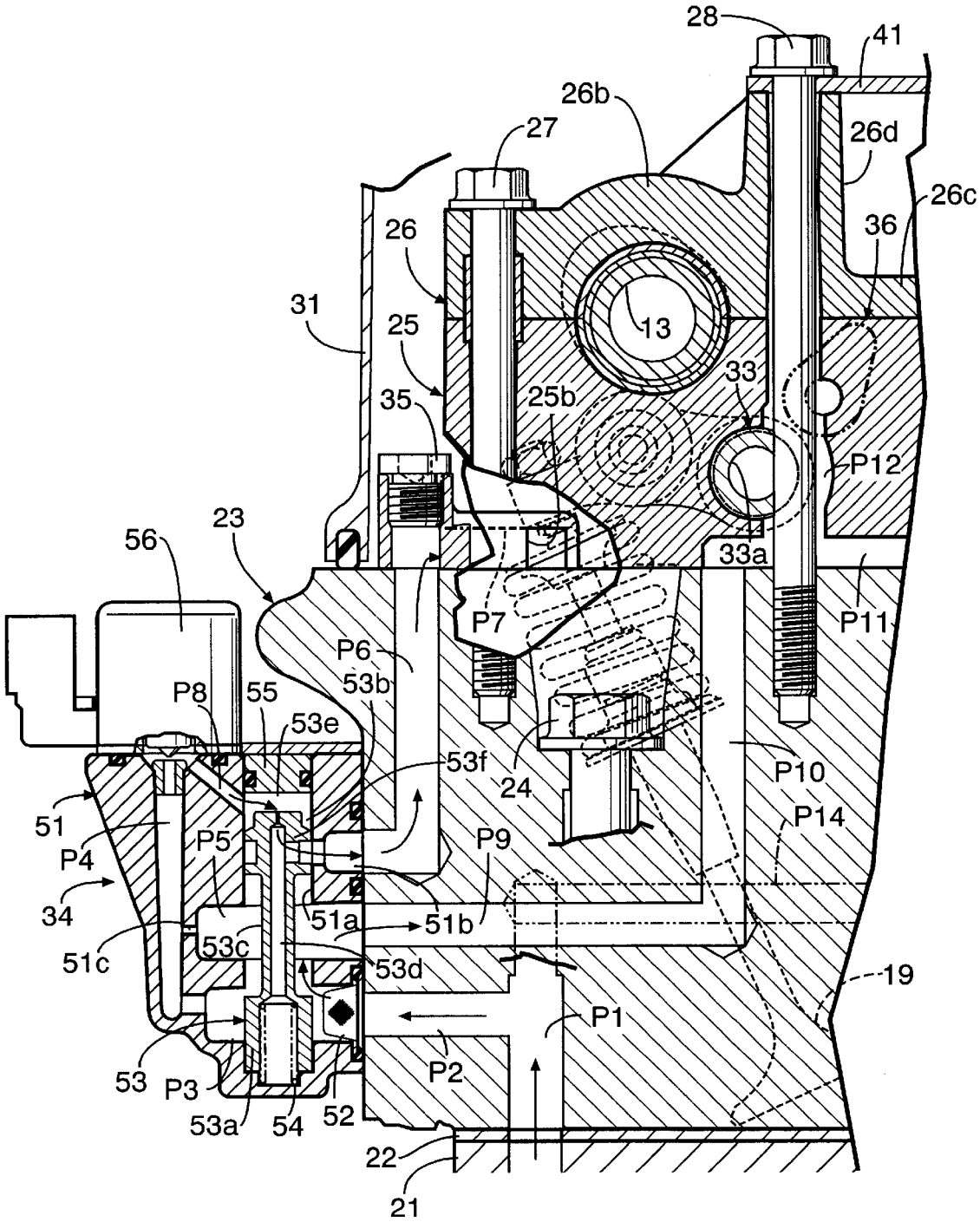

When the solenoid 56 of the first hydraulic pressure control valve 34 is brought into the turned-on state during rotation of the engine E at a higher speed to permit the communication between the oil passages P4 and P8, whereby the spool 53 is moved downwards by the hydraulic pressure applied to the land 53*b*, as shown in FIG. 6, the oil passages P3 and P5 are brought into communication with each other through the groove 53*c*. As a result, the higher hydraulic pressure is transmitted via the oil passages P9 and P10 in the cylinder head 23, the oil passages P11 and P13 in the lower camshaft holder 25 and the oil passage 32*a* in the intake rocker arm shaft 32 to the oil chamber 58*a* in the first valve-operating characteristic changing mechanism V1 to move the first, second and third switching pins 69, 70 and 71 against the repulsing force of the spring 73, whereby the pair of intake valves 18, 18 are driven with a higher valve lift.

When the hydraulic pressure output from the first hydraulic pressure control valve 34 is higher as described above, the hydraulic pressure transmitted through the oil passage P21 in the lower camshaft holder 25 and the oil passage 12*c* in the intake camshaft 12 show in FIG. 11 to the oil chamber 107 in the second valve-operating characteristic changing mechanism V2 is also brought into a higher pressure, whereby the stopper pin 105 is brought into engagement in the elongated groove 97*b* against the repulsing force of the spring 106. Therefore, a difference can be generated between the hydraulic pressures transmitted to the advance chambers 103 and the delay chambers 104 in the second valve-operating characteristic changing mechanism V2 through the pair of oil passages P17*a* and P17*b* by controlling the duty ratio of the second hydraulic pressure control valve 47 connected to the oil pump through the oil passages P1 and P14 in the cylinder head 23, the oil passage P15 in the filter housing 45 and the oil passage P16 in the cylinder head 23, whereby the phase of the inner rotor 96 relative to the outer rotor 93 can be changed within the angle β (see FIG. 12) to control the valve timing of the intake valves 18, 18.

Referring to FIG. 8, the higher-pressure oil supplied to the oil passage P12 defined around the outer periphery of the bolt 28 forces the relief valve 40 in the mounting bolt 39 of the oil jet 36 open, and spouts out of the nozzle bore 37*a* in the oil jet body 37 to lubricate the zone of starting of the meshing (or the meshed zone) of the intake camshaft sprocket 15 and the timing chain 17. Referring to FIG. 6, the oil supplied to the oil passage P8 in the first hydraulic pressure control valve 34 flows via the orifice 53*e*, the internal bore 53*d* and the groove 53*f* in the spool 53, the drain port 51*b* in the valve housing 51, the oil passage P6 in the cylinder head 23 and the oil passage P7 in the bulge 25*a* of the lower camshaft holder 25 and through the oil drain port 25*b* to the zone of starting of the meshing (or the meshed zone) of the exhaust camshaft sprocket 16 and the timing chain 17 to lubricate the timing chain 17 (see FIG. 7).

In this way, during the rotation of the engine E at the lower speed in which the load of the timing chain 17 is reduced, only the zone of starting of the meshing of the exhaust camshaft sprocket 16 and the timing chain 17 is lubricated. During the rotation of the engine E at the higher speed in which the load of the timing chain 17 is increased, the zone of starting of the meshing of the intake camshaft sprocket 15 and the timing chain 17 is lubricated concentratedly by the oil from the oil jet 36 and at the same time, the zone of starting of the meshing of the exhaust camshaft sprocket 16 and the timing chain 17 is lubricated subsidiarily by the relived oil from the oil drain port 25*b*. Therefore, it is possible to lubricate the timing chain 17 optimally in accordance with the operational state of the engine E to enhance the durability thereof.

In other words, the operations of the oil drain port 25*b* and the oil jet 36 which are a plurality of oil supply means for supplying the oil to the timing chain 17 are changed in accordance with the operational state of the engine E and hence, it is possible to carry out the lubrication of the timing chain 17 in accordance with the operational state of the engine E to reduce the wear of the timing chain 17. Moreover, the number of the oil supply means operated is increased with an increase in rotational speed of the engine E and hence, it is possible to increase the number of portions to be lubricated with an increase in load to further effectively reduce the wear of the timing chain 17.

Particularly, during the rotation of the engine E at the lower speed in which the valve lift (the medium valve lift) of the exhaust valves 19, 19 is larger than the valve lift (the smaller valve lift) of the intake valves 18, 18, a relatively large amount of the oil is supplied to the exhaust camshaft sprocket 16 having a load larger than that of the intake camshaft sprocket 15. During the rotation of the engine E at the higher speed in which the valve lift (the larger valve lift) of the intake valves 18, 18 is larger than the valve lift (the medium valve lift) of the exhaust valves 19, 19, a relatively large amount of the oil is supplied to the intake camshaft sprocket 15 having a load larger than that of the exhaust camshaft sprocket 16, and a smaller amount of the oil is also supplied to the exhaust camshaft sprocket 16. Thus, it is possible to secure an optimal amount of the oil in accordance with the operational state of the engine E.

Namely, the valve operating control system includes the first valve-operating characteristic changing mechanism V1 adapted to change the magnitude relationship between the lift amount of the intake valves 18, 18 and the lift amount of the exhaust valves 19, 19 in accordance with the operational state of the engine E, so that the amount of oil supplied to the meshed zone between the sprocket for driving the valve in the larger lift amount and the timing chain is larger than the amount of oil supplied to the meshed zone between the sprocket for driving the valve in the smaller lift amount and the timing chain 17. Therefore, it is possible to supply a larger amount of the oil to the sprocket having a larger valve-operating load to extend the life of the timing chain 17. Moreover, the valve operating control system includes the first hydraulic pressure control valve 34 adapted to change the lower-speed valve lift provided when the rotational speed of the engine is lower than a predetermined value and the higher-speed valve lift provided when the rotational speed of the engine is higher than the predetermined value from one to the other, so that the lower-speed valve lift is established by the first hydraulic pressure control valve 34 during rotation of the engine E at the lower speed, and the higher-speed valve lift is established by the first hydraulic pressure control valve 34 during rotation of the engine E at the higher speed, whereby the timing chain 17 is lubricated by the lower-pressure relived oil from the first hydraulic pressure control valve 34 at the lower-speed valve lift, and the timing chain 17 is lubricated by the higher-pressure valve-lift controlling oil from the first hydraulic pressure control valve 34 at the higher-speed valve lift. Therefore, an appropriate amount of the oil in accordance with the loaded state at that time can be supplied to effectively prevent the wear of the timing chain 17.

The structures of the oil passages leading to the first valve-operating characteristic changing mechanism V1 and the second valve-operating characteristic changing mechanism V2 will be further described below with reference to FIGS. 13 to 16.

The lower camshaft holder 25 and the upper camshaft holder 26 are superposed on and fastened to the upper surface of the cylinder head 23 by the four bolts 27, 28, 29 and 30, and the oil passages are defined intensively in the lower camshaft holder 25 interposed between the cylinder head 23 and the upper camshaft holder 26.

More specifically, the oil passage P11 (the valve-lift controlling oil passage of the present invention) is defined in a groove shape in the mating surface (see FIG. 14) of the lower camshaft holder 25 with the cylinder head 23 and leading to the first valve-operating characteristic changing mechanism V1 mounted on the intake rocker arm shaft 32. The oil passage P11 communicates with the pair of oil passages P12 and P13 extending along the outer peripheries of inner two 28 and 19 of the four bolts 27, 28, 29 and 30 and with the oil passage P10 defined in the cylinder head 23. The oil passages P18*a*,P18*b*; P19*a*, P19*b* (the valve lift controlling oil passages of the present invention) leading to the second valve-operating characteristic changing mechanism V2 mounted on the intake camshaft 12 are formed into an inverted L-shape. The oil passages P18*a* and P18*b* as lower half of the inverted L-shape extend vertically through the lower camshaft holder 25 and communicate with the oil passages P17*a* and P17*b* in the cylinder head, and the oil passages P19*a* and P19*b* as upper half of the inverted L-shape are formed into a groove-shape to extend along the mating surface (see FIG. 15) with the upper camshaft holder 26.

One of the four bolts 27, 28, 29 and 30 for fastening the lower camshaft holder 25 and the upper camshaft holder 26 to the upper surface of the cylinder head 26 extends through between the oil passages P19*a* and P19*b* defined in the upper surface of the lower camshaft holder 25 and through the end of the oil passage P11 defined in the lower surface of the lower camshaft holder 25. Since the bolt 29 extends through between the pair of oil passages P19*a* and P19*b*, the pair of oil passages P19*a* and P19*b* can be sealed uniformly. In addition, an area of the lower surface of the lower camshaft holder 25, where the oil passage P11 is closer to the oil passages P18*a* and P18*b*, is at a location between the two bolts 28 and 29 and hence, it is possible to effectively inhibit the leakage of the oil between the oil passage P11 and the oil passages P18*a* and P18*b* by the fastening forces of the two bolts 28 and 29.

Figure 16:
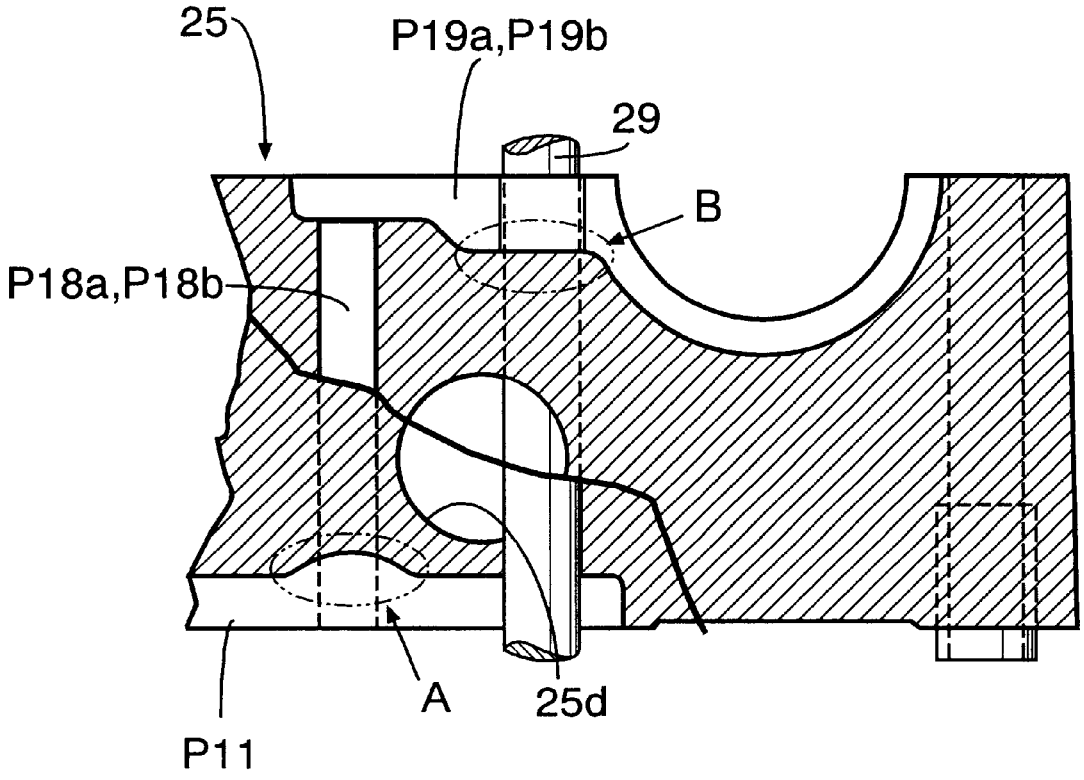

In a position where the oil passage P11 and the oil passages P18*a* and P18*b* are overlapped on each other as viewed in the axial directions of the intake camshaft 12 and the exhaust camshaft 13, the width of the oil passage P11 is slightly small, as compared with that in other positions in order to avoid the interference of the oil passage P11 with the oil passages P18*a* and P18*b* (see a portion indicated by A in FIG. 14), but in order to compensate for this, the depth of the oil passage P11 is large, as compared with that in the other positions (see a portion indicated by A in FIG. 16). Thus, it is possible to sufficiently secure the sectional area of the flow path in the oil passage P11 to prevent the responsiveness of the first valve-operating characteristic changing mechanism V1 from being reduced, while avoiding the interference of the oil passage P11 with the oil passages P18*a* and P18*b* and while avoiding an increase in size of the lower camshaft holder 25. By reducing the width of the oil passage P11 as compared with that in the other positions, as described above, the distance between the pair of oil passages P18*a* and P18*b* can be reduced to contribute to a reduction in size of the lower camshaft holder 25.

The pair of oil passages P18*a* and P18*b* are defined in the vicinity of the support portion 25*d* formed for the intake rocker arm shaft 32 on the lower camshaft holder 25, and hence, the support portion 25*d* is reinforced by a cylindrical portion defining the oil passages P18*a* and P18*b*, leading to an enhanced supported rigidity of the rocker arm shaft 32. By providing a reinforcing rib 25*e* outside one of the oil passages P18*a* in a protruding manner (see FIGS. 14 and 15), the rigidity of the support portion 25*d* for the intake rocker arm shaft 32 is further enhanced.

Figure 15:
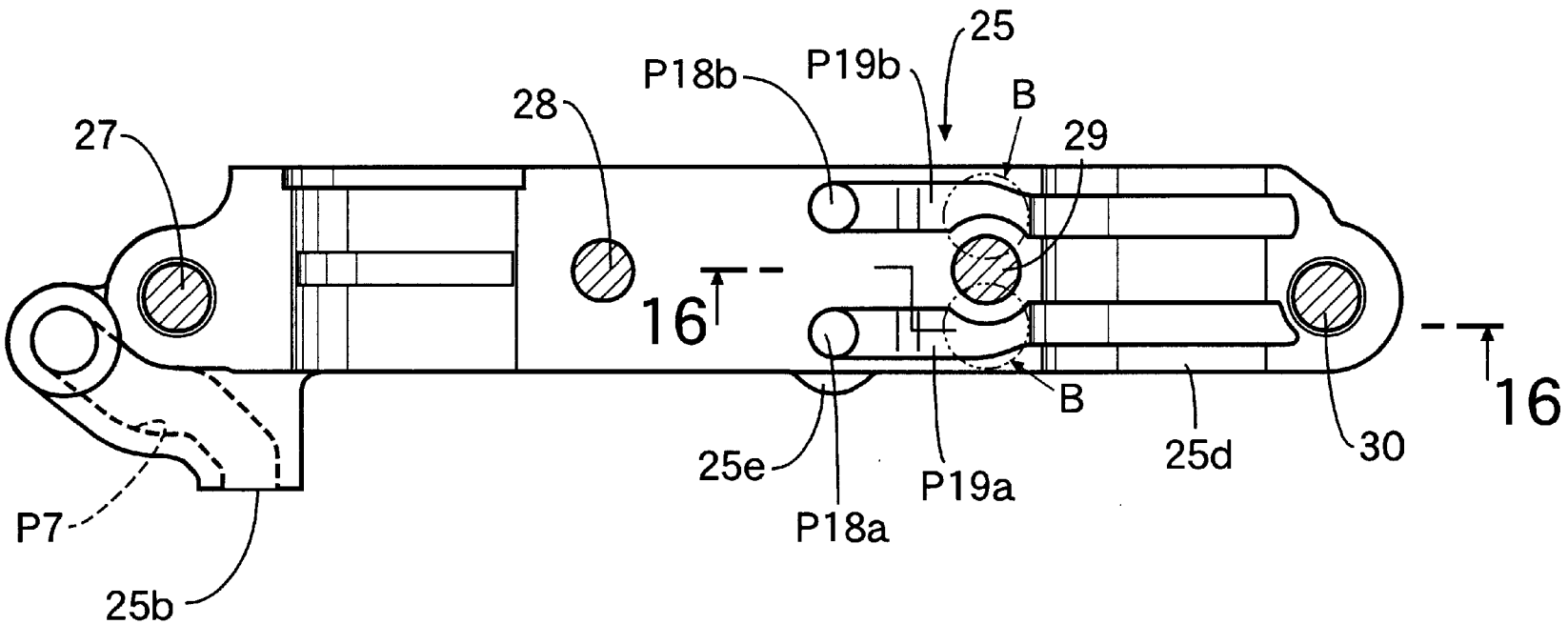

The bolt 29 extends through between the oil passages P19*a* and P19*b* defined in the upper surface of the lower camshaft holder 25 and hence, the widths of the oil passages P19*a* and P19*b* are reduced in a position where the oil passages P19*a* and P19*b* and the bolt 29 are overlapped on each other as viewed in the axial directions of the intake camshaft 12 and the exhaust camshaft 13 (see a portion indicated by B FIG. 15). In order to compensate for this, the depths of the oil passages P19*a* and P19*b* in the vicinity of the bolt 29 are larger, as compared with those in other positions (see a portion indicated by B in FIG. 16). Thus, it is possible to sufficiently secure the sectional area of the flow path in each of the oil passages P19*a* and P19*b* to prevent the responsiveness of the second valve-operating characteristic changing mechanism V2 from being reduced, while avoiding the interference of the bolt 29 with the oil passages P19*a* and P19*b* and while avoiding an increase in size of the lower camshaft holder 25. By reducing the widths of the pair of oil passages P19*a* and P19*b* as compared with those in the other positions, as described above, the distance between the pair of oil passages P19*a* and P19*b* can be reduced to contribute to a reduction in size of the lower camshaft holder 25.

As described above, the oil passages P7 and P11 are defined in the lower surface of the lower camshaft holder 25 (in the mating surface with the cylinder head 23); the oil passages P19*a* and P19*b* are defined in the upper surface of the lower camshaft holder 25 (in the mating surface with the upper camshaft holder 26), and the oil passages P12, P13, P18*a* and P18*b* are defined within the lower camshaft holder 25. Therefore, a large number of the oil passages can be disposed rationally by effectively utilizing the single lower camshaft holder 25.

In addition, the oil passages P18*a* and P18*b* are provided between inner two 28 and 29 of the four bolts 27, 28, 29 and 30 for fastening the lower camshaft holder 25 also serving as the lower arm shaft holder and the upper camshaft holder 26 to the cylinder head 23 and hence, the sealability on the upper surfaces (mating surfaces with the upper camshaft holder 26) and the lower surfaces (mating surfaces with the cylinder head 23) of the oil passages P18*a* and P18*b* is improved. Moreover, the oil passages P18*a* and P18*b* are provided in the support portion 25*d* for the intake rocker arm shaft 32 and hence, the lengths of the oil passages to the second valve-operating characteristic changing mechanism V2 mounted on the intake camshaft 12 can be reduced. Further, the oil passages P18*a* and P18*b* are provided in parallel to the bolts 28 and 29, which can contribute to the compactness of the lower camshaft holder 25.

The reinforcing rib 25*e* is formed outside one P18*a* of the pair of oil passages P18*a* and P18*b* in the embodiment, but may be provided outside the other oil passage P18*b*, or outside both of the oil passages P18*a* and P18*b*.

Although the embodiments of the present invention have been described in detail, it will be understood that the present invention is not limited to the above-described embodiments, and various modifications in design may be made without departing from the spirit and scope of the invention defined in claims.

What is claimed is:

1. A valve operating control system for an engine, comprising a first valve-operating characteristic changing mechanism adapted to change the valve lift, and a second valve-operating characteristic changing mechanism adapted to change the valve timing, wherein a pair of valve-timing controlling oil passages leading to said second valve-operating characteristic changing mechanism are defined in a camshaft support member, and a valve lift controlling oil passage leading to the first valve-operating characteristic changing mechanism is defined between said pair of valve-timing controlling oil passages in a mating surface of said camshaft support member with another member.

2. A valve operating control system for an engine according to claim 1, wherein the depth of said valve lift controlling oil passage in a position where said valve lift controlling oil passage and said pair of valve-timing controlling oil passages are overlapped on each other as viewed in an axial direction of a camshaft is larger than that in the other positions.

3. A valve operating control system for an engine according to claim 2, wherein said camshaft support member is fastened to another member by bolts; said pair of valve-timing controlling oil passages are defined in the mating surface of said camshaft support member with another member, and the depths of said pair of valve-timing controlling oil passages in a position where said pair of valve-timing controlling oil passages and said bolts are overlapped on each other as viewed in the axial direction of the camshaft are larger than those in other positions.

4. A valve operating control system for an engine according to claim 1 or 2, wherein said camshaft support member includes a support portion for a rocker arm shaft, and said pair of valve-timing controlling oil passages are defined in the vicinity of said support portion.

5. A valve operating control system for an engine according to claim 1, wherein said camshaft support member is fastened to another member by bolts; said pair of valve-timing controlling oil passages are defined in the mating surface of said camshaft support member with another member, and the depths of said pair of valve-timing controlling oil passages in a position where said pair of valve-timing controlling oil passages and said bolts are overlapped on each other as viewed in the axial direction of the camshaft are larger than those in other positions.

6. A valve operating control system for an engine according to claim 5, wherein said camshaft support member includes a support portion for a rocker arm shaft, and said pair of valve-timing controlling oil passages are defined in the vicinity of said support portion.

7. A valve operating control system for an engine according to claim 1, wherein the width of said valve lift controlling oil passage in a longitudinal direction of the camshaft in a position where the valve lift controlling oil passage and the pair of valve-timing controlling oil passages are overlapped on each other as viewed in the axial direction of the camshaft is smaller than that in the other positions.

8. A valve operating control system for an engine according to claim 1, wherein said camshaft support member is fastened to another member by bolts; said pair of valve-timing controlling oil passages are defined in the mating surface of the camshaft support member with another member, and the widths of said pair of valve-timing controlling oil passages in a longitudinal direction of the camshaft in a position where said pair of valve-timing controlling oil passages and said bolts are overlapped on each other as viewed in the axial direction of the camshaft are smaller than those in the other positions.

9. A valve operating control system for an engine according to claim 1, 2 or 7, wherein the position where said valve lift controlling oil passage and said pair of valve-timing controlling oil passages are overlapped on each other as viewed in the axial direction of the camshaft is between the bolts for fastening said camshaft support member mounted between a plurality of the camshafts to the cylinder head.

* * * * *